US009506320B2

(12) United States Patent
Dykstra et al.

(10) Patent No.: US 9,506,320 B2
(45) Date of Patent: Nov. 29, 2016

(54) VARIABLE FLOW RESISTANCE FOR USE WITH A SUBTERRANEAN WELL

(71) Applicant: HALLIBURTON ENERGY SERVICES, INC., Houston, TX (US)

(72) Inventors: Jason D. Dykstra, Carrollton, TX (US); Michael L. Fripp, Carrollton, TX (US); Liang Zhao, Carrollton, TX (US); Frederic Felten, Corinth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 826 days.

(21) Appl. No.: 13/659,323

(22) Filed: Oct. 24, 2012

(65) Prior Publication Data

US 2013/0112423 A1 May 9, 2013

(30) Foreign Application Priority Data

Nov. 7, 2011 (WO) ..... PCT/US2011/059530

(51) Int. Cl.

| | |
|---|---|
| ***E21B 34/08*** | (2006.01) |
| ***E21B 43/12*** | (2006.01) |
| ***E21B 43/14*** | (2006.01) |

(52) U.S. Cl.

CPC ..... *E21B 34/08* (2013.01); *E21B 43/12* (2013.01); *E21B 43/14* (2013.01)

(58) Field of Classification Search

CPC ..... E21B 34/08; E21B 43/12; E21B 43/14; E21B 34/06; F15C 1/16; F15C 1/00; F15C 1/02; F15C 1/04; F15C 1/003; F15C 1/18; F15C 5/00; F15C 1/143; F15C 1/14; F15C 1/10; F15C 1/08; F15C 1/008; F15D 1/0015; E03F 5/106

USPC ..... 166/316, 319, 373, 386; 137/808, 812, 137/804, 805, 810, 815, 823, 837, 838, 806, 137/829, 830, 834

See application file for complete search history.

(56) References Cited

U.S. PATENT DOCUMENTS

| | | | |
|---|---|---|---|
| 2,140,735 | A | 12/1938 | Clarke et al. |
| 2,324,819 | A | 6/1941 | Butzbach |

(Continued)

FOREIGN PATENT DOCUMENTS

| | | | |
|---|---|---|---|
| EP | 0834342 | A2 | 4/1998 |
| EP | 1857633 | A2 | 11/2007 |

(Continued)

OTHER PUBLICATIONS

For the American Heritage Dictionary definition: airfoil. (n.d.) The American Heritage® Dictionary of the English Language, Fourth Edition. (2003). Retrieved Apr. 11, 2013 from http://www.thefreedictionary.com/airfoil.*

(Continued)

*Primary Examiner* — Shane Bomar
*Assistant Examiner* — Wei Wang
(74) *Attorney, Agent, or Firm* — Locke Lord LLP

(57) ABSTRACT

A variable flow resistance system for use with a subterranean well can include a structure which displaces in response to a flow of a fluid composition, whereby a resistance to the flow of the fluid composition changes in response to a change in a ratio of desired to undesired fluid in the fluid composition. Another system can include a structure which rotates in response to flow of a fluid composition, and a fluid switch which deflects the fluid composition relative to at least two flow paths. A method of variably resisting flow in a subterranean well can include a structure displacing in response to a flow of a fluid composition, and a resistance to the flow of the fluid composition changing in response to a ratio of desired to undesired fluid in the fluid composition changing. Swellable materials and airfoils may be used in variable flow resistance systems.

12 Claims, 21 Drawing Sheets

(56) References Cited

U.S. PATENT DOCUMENTS 3,078,862 A 2/1963 Maly
3,091,393 A 5/1963 Sparrow
3,216,439 A 11/1965 Manion
3,233,621 A 2/1966 Manion
3,256,899 A 6/1966 Dexter et al.
3,282,279 A 11/1966 Manion
3,343,790 A 9/1967 Bowles
3,385,367 A 5/1968 Kollsman
3,461,897 A 8/1969 Kwok
3,470,894 A 10/1969 Rimmer
3,474,670 A 10/1969 Rupert
3,489,009 A 1/1970 Rimmer
3,515,160 A 6/1970 Cohen
3,529,614 A 9/1970 Nelson
3,537,466 A 11/1970 Chapin
3,566,900 A 3/1971 Black
3,586,104 A 6/1971 Hyde
3,598,137 A 8/1971 Glaze
3,620,238 A 11/1971 Kawabata
3,670,753 A 6/1972 Healey
3,704,832 A 12/1972 Fix et al.
3,712,321 A 1/1973 Bauer
3,717,164 A 2/1973 Griffin
3,754,576 A * 8/1973 Zetterstrom et al. ..... 137/829
3,776,460 A 12/1973 Fichter
3,885,627 A 5/1975 Berry et al.
3,885,931 A 5/1975 Schaller
3,942,557 A 3/1976 Tsuchiya
4,029,127 A 6/1977 Thompson
4,082,169 A 4/1978 Bowles
4,127,173 A 11/1978 Watkins et al.
4,167,073 A 9/1979 Tang
4,187,909 A 2/1980 Erbstoesser
4,276,943 A 7/1981 Holmes
4,286,627 A 9/1981 Graf
4,291,395 A 9/1981 Holmes
4,307,653 A 12/1981 Goes et al.
4,323,991 A 4/1982 Holmes et al.
4,385,875 A 5/1983 Kanazawa
4,390,062 A 6/1983 Fox
4,418,721 A 12/1983 Holmes
4,518,013 A 5/1985 Lazarus
4,557,295 A 12/1985 Holmes
4,846,224 A 7/1989 Collin, Jr. et al.
4,895,582 A 1/1990 Bielefeldt
4,919,204 A 4/1990 Baker et al.
5,052,442 A 10/1991 Johannessen
5,158,579 A 10/1992 Carstensen
5,165,450 A 11/1992 Marrelli
5,184,678 A 2/1993 Pechkov et al.
5,303,782 A 4/1994 Johannessen
5,455,804 A 10/1995 Holmes et al.
5,482,117 A 1/1996 Kolpak et al.
5,484,016 A 1/1996 Surjaatmadja et al.
5,505,262 A 4/1996 Cobb
5,533,571 A 7/1996 Surjaatmadja et al.
5,570,744 A 11/1996 Weingarten et al.
5,893,383 A 4/1999 Facteau
6,015,011 A 1/2000 Hunter
6,078,471 A 6/2000 Fiske
6,109,372 A 8/2000 Dorel et al.
6,112,817 A 9/2000 Voll et al.
6,241,019 B1 6/2001 Davidson et al.
6,336,502 B1 1/2002 Surjaatmadja et al.
6,345,963 B1 2/2002 Thomin et al.
6,367,547 B1 4/2002 Towers et al.
6,371,210 B1 4/2002 Bode et al.
6,402,820 B1 6/2002 Tippetts et al.
6,405,797 B2 6/2002 Davidson et al.
6,497,252 B1 12/2002 Kohler et al.
6,619,394 B2 9/2003 Soliman et al.
6,622,794 B2 9/2003 Zisk, Jr.
6,627,081 B1 9/2003 Hilditch et al.
6,644,412 B2 11/2003 Bode et al.
6,691,781 B2 2/2004 Grant et al.
6,719,048 B1 4/2004 Ramos et al.
6,851,473 B2 2/2005 Davidson
6,913,079 B2 7/2005 Tubel
6,976,507 B1 12/2005 Webb et al.
7,025,134 B2 4/2006 Byrd et al.
7,059,415 B2 6/2006 Bosma et al.
7,114,560 B2 10/2006 Nguyen et al.
7,185,706 B2 3/2007 Freyer
7,213,650 B2 5/2007 Lehman et al.
7,213,681 B2 5/2007 Birchak et al.
7,216,738 B2 5/2007 Birchak et al.
7,290,606 B2 11/2007 Coronado et al.
7,318,471 B2 1/2008 Rodney et al.
7,404,416 B2 7/2008 Schultz et al.
7,405,998 B2 7/2008 Webb et al.
7,409,999 B2 8/2008 Henriksen et al.
7,413,010 B2 8/2008 Blauch et al.
7,537,056 B2 5/2009 MacDougall
7,578,343 B2 8/2009 Augustine
7,621,336 B2 11/2009 Badalamenti et al.
7,828,067 B2 11/2010 Scott et al.
7,857,050 B2 12/2010 Zazovsky et al.
8,127,856 B1 3/2012 Nish et al.
8,235,128 B2 8/2012 Dykstra et al.
8,261,839 B2 9/2012 Fripp et al.
8,267,669 B2 9/2012 Kagan
8,302,696 B2 11/2012 Williams et al.
8,327,885 B2 12/2012 Dykstra et al.
8,356,668 B2 1/2013 Dykstra et al.
8,381,817 B2 2/2013 Schultz et al.
8,418,725 B2 4/2013 Schultz et al.
8,430,130 B2 4/2013 Dykstra
8,439,117 B2 5/2013 Schultz et al.
8,453,745 B2 6/2013 Schultz et al.
8,464,759 B2 6/2013 Dykstra
8,479,831 B2 7/2013 Dykstra et al.
8,517,105 B2 8/2013 Schultz et al.
8,517,106 B2 8/2013 Schultz et al.
8,517,107 B2 8/2013 Schultz et al.
8,517,108 B2 8/2013 Schultz et al.
8,555,924 B2 10/2013 Faram et al.
8,555,975 B2 10/2013 Dykstra et al.
8,584,762 B2 11/2013 Fripp et al.
8,602,106 B2 12/2013 Lopez
8,657,017 B2 2/2014 Dykstra et al.
2004/0020662 A1 2/2004 Freyer
2006/0131033 A1 6/2006 Bode et al.
2007/0028977 A1 2/2007 Goulet
2007/0045038 A1 3/2007 Han et al.
2007/0246407 A1 10/2007 Richards et al.
2007/0256828 A1 11/2007 Birchak et al.
2007/0257405 A1 11/2007 Freyer
2008/0035350 A1 2/2008 Henriksen et al.
2008/0041580 A1 2/2008 Freyer et al.
2008/0041581 A1 2/2008 Richards
2008/0041582 A1 2/2008 Saetre et al.
2008/0041588 A1 2/2008 Richards et al.
2008/0149323 A1 6/2008 O'Malley et al.
2008/0169099 A1 7/2008 Pensgaard
2008/0236839 A1 10/2008 Oddie
2008/0261295 A1 10/2008 Butler et al.
2008/0283238 A1 11/2008 Richards et al.
2008/0314590 A1 12/2008 Patel
2009/0000787 A1 1/2009 Hill et al.
2009/0008088 A1 1/2009 Schultz et al.
2009/0008090 A1 1/2009 Schultz et al.
2009/0009297 A1 1/2009 Shinohara et al.
2009/0009333 A1 1/2009 Bhogal et al.
2009/0009336 A1 1/2009 Ishikawa
2009/0009412 A1 1/2009 Warther
2009/0009437 A1 1/2009 Hwang et al.
2009/0009445 A1 1/2009 Lee
2009/0009447 A1 1/2009 Naka et al.
2009/0065197 A1 3/2009 Eslinger
2009/0078427 A1 3/2009 Patel
2009/0078428 A1 3/2009 Ali
2009/0101354 A1 4/2009 Holmes et al.

(56) References Cited

U.S. PATENT DOCUMENTS

| | | | |
|---|---|---|---|
| 2009/0120647 | A1 | 5/2009 | Turick et al. |
| 2009/0133869 | A1 | 5/2009 | Clem |
| 2009/0151925 | A1 | 6/2009 | Richards et al. |
| 2009/0159282 | A1 | 6/2009 | Webb et al. |
| 2009/0250224 | A1 | 10/2009 | Wright et al. |
| 2009/0277639 | A1 | 11/2009 | Schultz et al. |
| 2009/0277650 | A1 | 11/2009 | Casciaro et al. |
| 2011/0042091 | A1 | 2/2011 | Dykstra et al. |
| 2011/0042092 | A1 | 2/2011 | Fripp et al. |
| 2011/0079384 | A1 | 4/2011 | Russell et al. |
| 2011/0186300 | A1 | 8/2011 | Dykstra et al. |
| 2011/0198097 | A1 | 8/2011 | Moen |
| 2011/0214876 | A1 | 9/2011 | Dykstra et al. |
| 2011/0297384 | A1 | 12/2011 | Fripp et al. |
| 2011/0297385 | A1 | 12/2011 | Dykstra et al. |
| 2011/0308806 | A9 | 12/2011 | Dykstra et al. |
| 2012/0048563 | A1 | 3/2012 | Holderman |
| 2012/0060624 | A1 | 3/2012 | Dykstra |
| 2012/0061088 | A1 | 3/2012 | Dykstra et al. |
| 2012/0111577 | A1 | 5/2012 | Dykstra et al. |
| 2012/0145385 | A1 | 6/2012 | Lopez |
| 2012/0181037 | A1 | 7/2012 | Holderman |
| 2012/0211243 | A1 | 8/2012 | Dykstra et al. |
| 2012/0227813 | A1 | 9/2012 | Meek et al. |
| 2012/0234557 | A1 | 9/2012 | Dykstra et al. |
| 2012/0255351 | A1 | 10/2012 | Dykstra |
| 2012/0255739 | A1 | 10/2012 | Fripp |
| 2012/0255740 | A1 | 10/2012 | Fripp et al. |
| 2012/0292017 | A1 | 11/2012 | Schultz et al. |
| 2012/0292018 | A1 | 11/2012 | Schultz et al. |
| 2012/0292019 | A1 | 11/2012 | Schultz et al. |
| 2012/0292020 | A1 | 11/2012 | Schultz et al. |
| 2012/0292033 | A1 | 11/2012 | Schultz et al. |
| 2012/0292116 | A1 | 11/2012 | Schultz et al. |
| 2013/0048299 | A1 | 2/2013 | Fripp et al. |
| 2013/0075107 | A1 | 3/2013 | Dykstra et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0153238 | A1 | 6/2013 | Fripp et al. |
| 2013/0180727 | A1 | 7/2013 | Dykstra et al. |
| 2013/0186634 | A1 | 7/2013 | Fripp et al. |
| 2013/0220633 | A1 | 8/2013 | Felten |
| 2013/0255960 | A1 | 10/2013 | Fripp et al. |
| 2013/0277066 | A1 | 10/2013 | Fripp et al. |
| 2013/0299198 | A1 | 11/2013 | Gano et al. |
| 2014/0014351 | A1 | 1/2014 | Zhao et al. |
| 2014/0041731 | A1 | 2/2014 | Fripp et al. |
| 2014/0048280 | A9 | 2/2014 | Fripp et al. |
| 2014/0048282 | A1 | 2/2014 | Dykstra et al. |

FOREIGN PATENT DOCUMENTS

| | | | |
|---|---|---|---|
| EP | 2146049 | A2 | 1/2010 |
| EP | 2383430 | A2 | 11/2011 |
| RU | 2358103 | C2 | 6/2009 |
| WO | 0214647 | A1 | 2/2002 |
| WO | 03062597 | A1 | 7/2003 |
| WO | 2004033063 | A2 | 4/2004 |
| WO | WO-2005/080750 | A1 | 9/2005 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | WO-2013070182 | A1 | 5/2013 |

OTHER PUBLICATIONS

Office Action issued Nov. 2, 2011 for U.S. Appl. No. 12/792,146, 34 pages.

Office Action issued Nov. 3, 2011 for U.S. Appl. No. 13/111,169, 16 pages.

Office Action issued Nov. 2, 2011 for U.S. Appl. No. 12/792,117, 35 pages.

Office Action issued Oct. 27, 2011 for U.S. Appl. No. 12/791,993, 15 pages.

Office Action issued Oct. 26, 2011 for U.S. Appl. No. 13/111,169, 28 pages.

International Search Report with Written Opinion issued Jan. 5, 2012 for PCT Patent Application No. PCT/US2011/047925, 9 pages.

Stanley W. Angrist; "Fluid Control Devices", published Dec. 1964, 5 pages.

Specification and Drawings for U.S. Appl. No. 12/542,695, filed Aug. 18, 2009, 32 pages.

International Search Report with Written Opinion issued Aug. 3, 2012 for PCT Patent Application No. PCT/US11/059530, 15 pages.

International Search Report with Written Opinion issued Aug. 3, 2012 for PCT Patent Application No. PCT/US11/059534, 14 pages.

Office Action issued Jul. 25, 2012 for U.S. Appl. No. 12/881,296, 61 pages.

Search Report and Written Opinion issued Oct. 19, 2012 for International Application No. PCT/US12/30641, 9 pages.

Advisory Action issued Aug. 30, 2012 for U.S. Appl. No. 13/111,169, 15 pages.

Office Action issued Sep. 10, 2012 for U.S. Appl. No. 12/792,095, 59 pages.

Office Action issued Mar. 4, 2013 for U.S. Appl. No. 13/659,375, 24 pages.

Office Action issued Feb. 21, 2013 for U.S. Appl. No. 12/792,095, 26 pages.

Office Action issued Mar. 4, 2013 for U.S. Appl. No. 13/678,497, 26 pages.

Advisory Action issued Mar. 14, 2013 for U.S. Appl. No. 13/495,078, 14 pages.

Search Report issued Aug. 3, 2012 for International Application serial No. PCT/US11/59530, 5 pages.

Written Opinion issued Aug. 3, 2012 for International Application serial No. PCT/US11/59530, 10 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Office Action issued Jun. 27, 2011, for U.S. Appl. No. 12/791,993, 17 pages.

Joseph M. Kirchner, "Fluid Amplifiers", 1996, 6 pages, McGraw-Hill, New York.

Joseph M. Kirchner, et al., "Design Theory of Fluidic Components", 1975, 9 pages, Academic Press, New York.

Microsoft Corporation, "Fluidics" article, Microsoft Encarta Online Encyclopedia, copyright 1997-2009, 1 page, USA.

The Lee Company Technical Center, "Technical Hydraulic Handbook" 11th Edition, copyright 1971-2009, 7 pages, Connecticut.

Specification and Drawings for U.S. Appl. No. 12/792,095, filed Jun. 2, 2010, 29 pages.

(56) References Cited

OTHER PUBLICATIONS

Specification and Drawings for U.S. Appl. No. 10/650,186, filed Aug. 28, 2003, 16 pages.
Apparatus and Method of Inducing Fluidic Oscillation in a Rotating Cleaning Nozzle, ip.com, dated Apr. 24, 2007, 3 pages.
Specification and Drawings for U.S. Appl. No. 13/430,507, filed Mar. 26, 2012, 28 pages.
International Search Report with Written Opinion issued Mar. 26, 2012 for PCT Patent Application No. PCT/US11/048986, 9 pages.
International Search Report with Written Opinion issued Apr. 17, 2012 for PCT Patent Application No. PCT/US11/050255, 9 pages.
Office Action issued May 24, 2012 for U.S. Appl. No. 12/869,836, 60 pages.
Office Action issued May 24, 2012 for U.S. Appl. No. 13/430,507, 17 pages.
Office Action issued Jan. 16, 2013 for U.S. Appl. No. 13/495,078, 24 pages.
Office Action issued Jan. 17, 2013 for U.S. Appl. No. 12/879,846, 26 pages.
Office Action issued Jan. 22, 2013 for U.S. Appl. No. 13/633,693, 30 pages.
International Search Report with Written Opinion dated Aug. 31, 2012 for PCT Patent Application No. PCT/US11/060606, 10 pages.
Office Action issued Sep. 19, 2012 for U.S. Appl. No. 12/879,846, 78 pages.
Office Action issued Sep. 19, 2012 for U.S. Appl. No. 13/495,078, 29 pages.
Specification and Drawings for U.S. Appl. No. 13/659,375, filed Oct. 24, 2012, 54 pages.
International Search Report with Written Opinion dated Aug. 3, 2012 for PCT Patent Application No. PCT/US11/059530, 15 pages.
International Search Report with Written Opinion dated Aug. 3, 2012 for PCT Patent Application No. PCT/US11/059534, 14 pages.
Office Action issued Dec. 28, 2012 for U.S. Appl. No. 12/881,296, 29 pages.
Stanley W. Angrist; "Fluid Control Devices", Scientific American Magazine, dated Dec. 1964, 8 pages.
Rune Freyer et al.; "An Oil Selective Inflow Control System", Society of Petroleum Engineers Inc. paper, SPE 78272, dated Oct. 29-31, 2002, 8 pages.
Office Action issued May 29, 2013 for U.S. Appl. No. 12/881,296, 26 pages.
Patent Application and Drawings for, U.S. Appl. No. 13/351,035, filed Jan. 16, 2012, 62 pages.
Patent Application and Drawings for, U.S. Appl. No. 13/359,617, filed Jan. 27, 2012, 42 pages.
Patent Application and Drawings for, U.S. Appl. No. 12/958,625, filed Dec. 2, 2010, 37 pages.
Patent Application and Drawings for, U.S. Appl. No. 12/974,212, filed Dec. 21, 2010, 41 pages.
Office Action issued Mar. 7, 2012 for U.S. Appl. No. 12/792,117, 40 pages.
Office Action issued Mar. 8, 2012 for U.S. Appl. No. 12/792,146, 26 pages.
Office Action issued Jun. 19, 2012 for U.S. Appl. No. 13/111,169, 17 pages.
Office Action issued May 8, 2013 for U.S. Appl. No. 12/792,095, 14 pages.
Office Action issued Apr. 24, 2013 for U.S. Appl. No. 13/633,693, 33 pages.
Office Action issued Apr. 26, 2013 for U.S. Appl. No. 13/678,489, 51 pages.
Office Action issued Aug. 20, 2013 for U.S. Appl. No. 13/659,375, 24 pages.
Office Action issued Aug. 23, 2013 for U.S. Appl. No. 13/084,025, 93 pages.
Office Action issued Oct. 11, 2013 for U.S. Appl. No. 12/792,095, 18 pages.
Office Action issued Aug. 7, 2013 for U.S. Appl. No. 13/678,489, 24 pages.
Office Action issued Nov. 5, 2013 for U.S. Appl. No. 13/084,025, 23 pages.
Office Action issued Dec. 24, 2013 for U.S. Appl. No. 12/881,296, 30 pages.
Advisory Action issued Dec. 27, 2013 for U.S. Appl. No. 12/792,095, 8 pages.
Canadian Office Action dated Apr. 2, 2015 issued on corresponding Canadian Patent Application No. 2,851,559.
Canadian Office Action dated May 26, 2015 issued on corresponding Canadian Patent Applicaiton No. 2,851,561.
Australian Examination Report No. 1 dated Jun. 10, 2015, issued on corresponding Australian Patent Application No. 2011380934.
Partial Supplementary European Search Report dated Aug. 4, 2015 issued on corresponding European Patent Application No. 11875539.6.
PCT International Preliminary Report on Patentability dated May 13, 2014 issed on corresponding PCT International Application No. PCT/US2011/059534.
Office Action issued Mar. 11, 2014 for U.S. Appl. No. 13/351,035, 120 pages.
Office Action issued by the Bogota, Colombia PTO dated May 16, 2015 for Patent Application No. 14-084.477 in the name of Haliburton Energy Services, Inc.
Russian Office Action dated Nov. 18, 2015, and English translation thereof, issued during the prosecution of Russian Patent Application No. 2014121076/03.
Mexican Office Action dated Jul. 28, 2016, issued during the prosecution of Mexican Patent Application No. MX/a/2014/005512.
Canadian Office Action dated Feb. 17, 2016, issued during the prosecution of Canadian Patent Application No. 2,851,559.
Chinese Office Action dated Jul. 26, 2016, and English translation thereof, issued during the prosecution of Chinese Patent Application No. 201180074695.
Colombian Office Action dated Jun. 27, 2016, issued during the prosecution of Colombian Patent Application No. PCT/14-080606.
Extended European Search Report dated Dec. 3, 2015, issued on corresponding European Patent Application No. EP 11875323.5.
Colombian Office Action dated Nov. 23, 2015, and English translation thereof, issued on corresponding Colombian Patent Application No. 90313.
Colombian Office Action dated Nov. 20, 2015, and English translation thereof, issued on corresponding Colombian Patent Application No. 89809.

* cited by examiner

FIG. 13
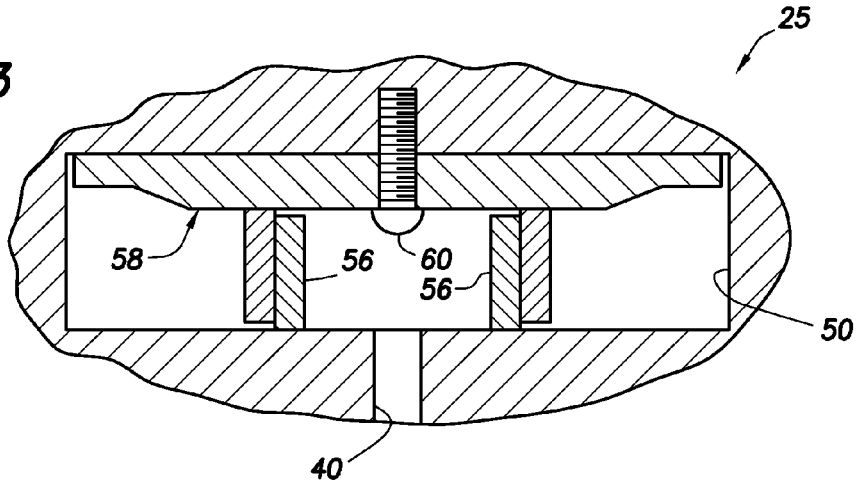
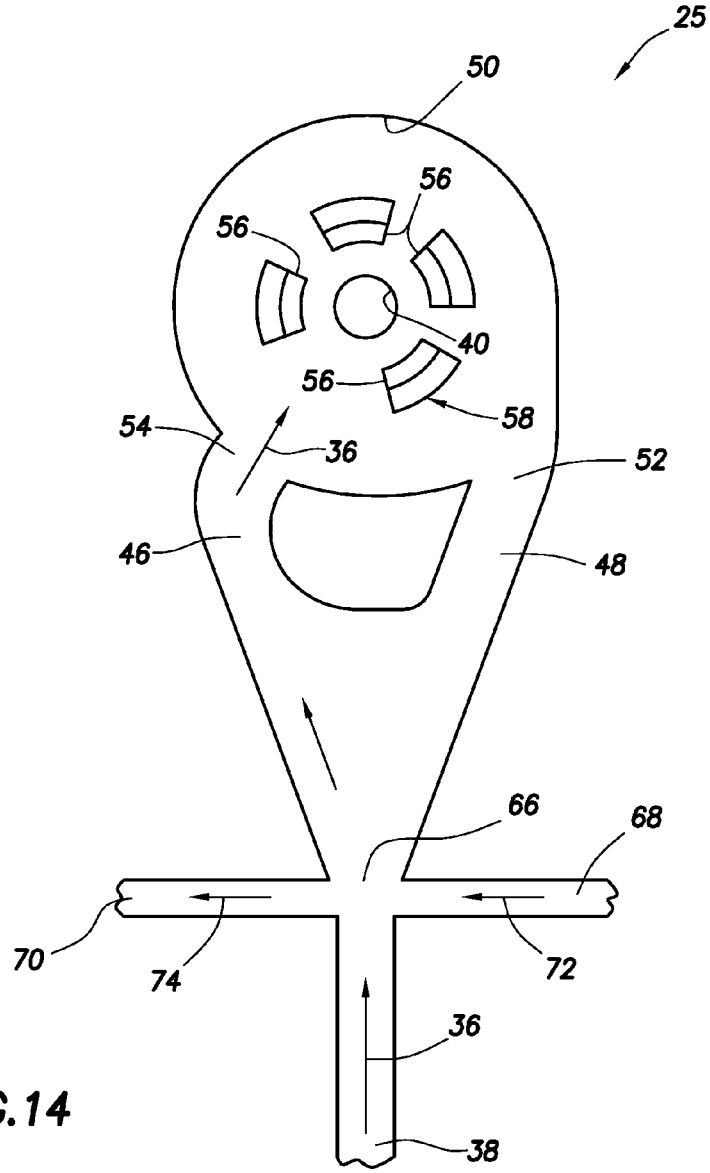
FIG. 14

VARIABLE FLOW RESISTANCE FOR USE WITH A SUBTERRANEAN WELL

CROSS-REFERENCE TO RELATED APPLICATION

This application claims the benefit under 35 USC §119 of the filing date of International Application Serial No. PCT/US11/59530, filed 7 Nov. 2011. The entire disclosure of this prior application is incorporated herein by this reference.

BACKGROUND

This disclosure relates generally to equipment utilized and operations performed in conjunction with a subterranean well and, in an example described herein, more particularly provides for variably resisting flow.

Among the many reasons for variably resisting flow are included: a) control of produced fluids, b) control over the origin of produced fluids, c) prevention of formation damage, d) conformance, e) control of injected fluids, f) control over which zones receive injected fluids, g) prevention of gas or water coning, h) stimulation, etc. Therefore, it will be appreciated that improvements in the art are continually needed.

SUMMARY

In this disclosure, systems and methods are provided which bring improvements to the art of variably resisting flow of fluids in conjunction with well operations. One example is described below in which a change in direction of flow of fluids through a variable flow resistance system changes a resistance to the flow. Another example is described below in which a change in a structure changes the flow resistance of the system.

In one described example, a variable flow resistance system can include a structure which displaces in response to a flow of a fluid composition. A resistance to the flow of the fluid composition changes in response to a change in a ratio of desired to undesired fluid in the fluid composition.

In another example, a variable flow resistance system can include a structure which rotates in response to flow of a fluid composition, and a fluid switch which deflects the fluid composition relative to at least two flow paths. In this example also, a resistance to the flow of the fluid composition through the system changes in response to a change in a ratio of desired to undesired fluid in the fluid composition.

In a further example, a variable flow resistance system can include a chamber through which a fluid composition flows, whereby a resistance to a flow of the fluid composition through the chamber varies in response to a change in a direction of the flow through the chamber, and a material which swells in response to a decrease in a ratio of desired to undesired fluid in the fluid composition.

In yet another example, a variable flow resistance system can include at least two flow paths, whereby a resistance to a flow of a fluid composition through the system changes in response to a change in a proportion of the fluid composition which flows through the flow paths. In this example, an airfoil changes a deflection of the flow of the fluid composition relative to the flow paths in response to a change in a ratio of desired to undesired fluid in the fluid composition.

A further example comprises a method of variably resisting flow in a subterranean well. The method can include a structure displacing in response to a flow of a fluid composition, and a resistance to the flow of the fluid composition changing in response to a change in a ratio of desired to undesired fluid in the fluid composition.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

BRIEF DESCRIPTION OF THE DRAWINGS

FIG. 13 is a representative cross-sectional view of the FIG. 12 configuration, taken along line 13-13.

FIG. 14 is a representative cross-sectional view of another configuration of the variable flow resistance system.

DETAILED DESCRIPTION

Figure 1:
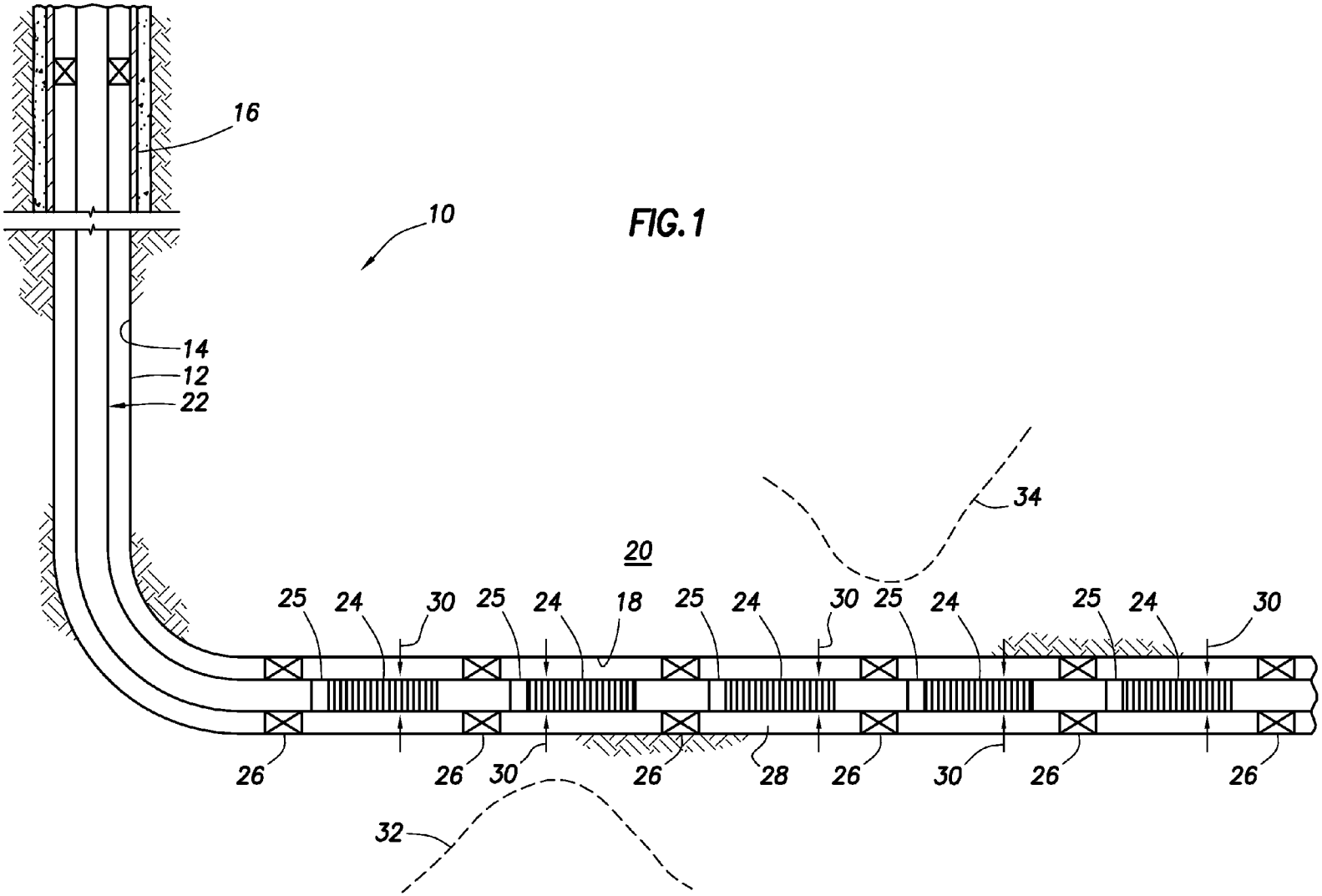
FIG. 1 is a representative partially cross-sectional view of a well system and associated method which can embody principles of this disclosure.

Representatively illustrated in FIG. 1 is a system 10 for use with a well, which system can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the system 10 is illustrated in the drawings and is described herein as merely one example of a wide variety of systems in which the principles of this disclosure can be utilized. It should be clearly understood that the principles of this disclosure are not limited at all to any of the details of the system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, transmitting signals, etc.

In examples described below, resistance to flow through the flow resistance systems 25 can be selectively varied, on demand and/or in response to a particular condition. For example, flow through the systems 25 could be relatively restricted while the tubular string 22 is installed, and during a gravel packing operation, but flow through the systems could be relatively unrestricted when producing the fluid 30 from the formation 20. As another example, flow through the systems 25 could be relatively restricted at elevated temperature indicative of steam breakthrough in a steam flooding operation, but flow through the systems could be relatively unrestricted at reduced temperatures.

An example of the variable flow resistance systems 25 described more fully below can also increase resistance to flow if a fluid velocity or density increases (e.g., to thereby balance flow among zones, prevent water or gas coning, etc.), or increase resistance to flow if a fluid viscosity decreases (e.g., to thereby restrict flow of an undesired fluid, such as water or gas, in an oil producing well). Conversely, these variable flow resistance systems 25 can decrease resistance to flow if fluid velocity or density decreases, or if fluid viscosity increases.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. If it is desired to inject steam instead of water, then steam is a desired fluid and water is an undesired fluid. If it is desired to produce hydrocarbon gas and not water, then hydrocarbon gas is a desired fluid and water is an undesired fluid.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
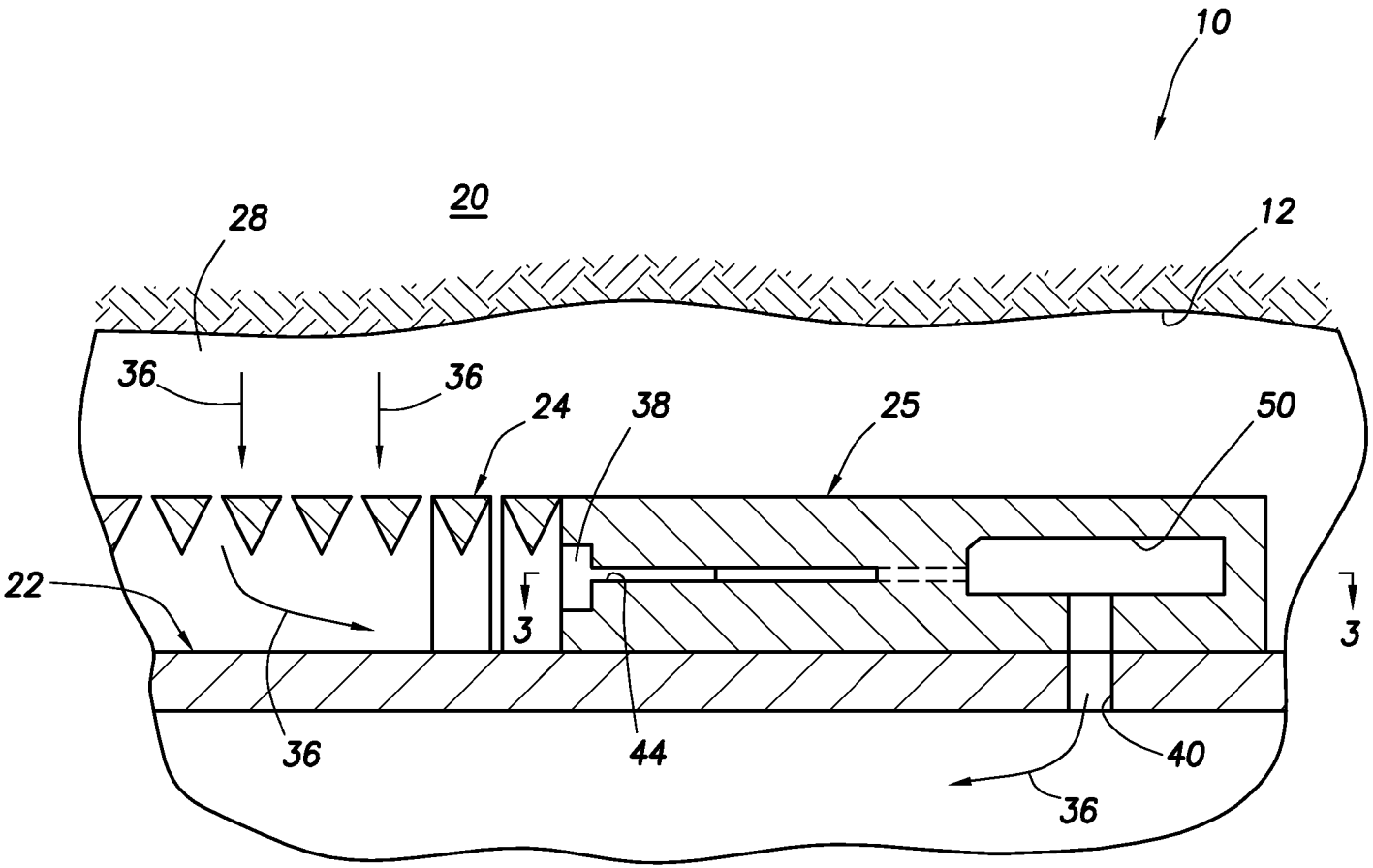
FIG. 2 is a representative cross-sectional view of a variable flow resistance system which can embody the principles of this disclosure.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and liquid water can be combined in a fluid composition. As another example, oil, water and/or gas can be combined in a fluid composition.

Flow of the fluid composition 36 through the variable flow resistance system 25 is resisted based on one or more characteristics (such as viscosity, velocity, density, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3:
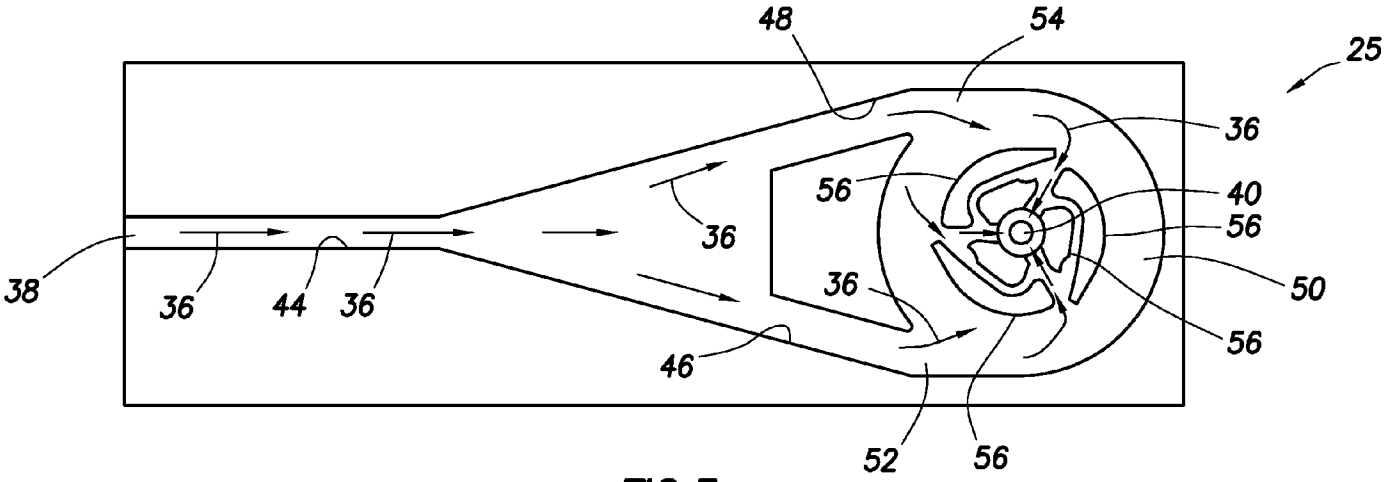
FIG. 3 is a representative cross-sectional view of the variable flow resistance system, taken along line 3-3 of FIG. 2.

Referring additionally now to FIG. 3, a cross-sectional view of the variable flow resistance system 25, taken along line 3-3 of FIG. 2, is representatively illustrated. The variable flow resistance system 25 example depicted in FIG. 3 may be used in the well system 10 of FIGS. 1 & 2, or it may be used in other well systems in keeping with the principles of this disclosure.

In FIG. 3, it may be seen that the fluid composition 36 flows from the inlet 38 to the outlet 40 via passage 44, inlet flow paths 46, 48 and a flow chamber 50. The flow paths 46, 48 are branches of the passage 44 and intersect the chamber 50 at inlets 52, 54.

Although in FIG. 3 the flow paths 46, 48 diverge from the inlet passage 44 by approximately the same angle, in other examples the flow paths 46, 48 may not be symmetrical with respect to the passage 44. For example, the flow path 48 could diverge from the inlet passage 44 by a smaller angle as compared to the flow path 46, so that more of the fluid composition 36 will flow through the flow path 48 to the chamber 50, and vice versa.

A resistance to flow of the fluid composition 36 through the system 25 depends on proportions of the fluid composition which flow into the chamber via the respective flow paths 46, 48 and inlets 52, 54. As depicted in FIG. 3, approximately half of the fluid composition 36 flows into the chamber 50 via the flow path 46 and inlet 52, and about half of the fluid composition flows into the chamber via the flow path 48 and inlet 54.

In this situation, flow through the system 25 is relatively unrestricted. The fluid composition 36 can readily flow between various vane-type structures 56 in the chamber 50 en route to the outlet 40.

Figure 4:
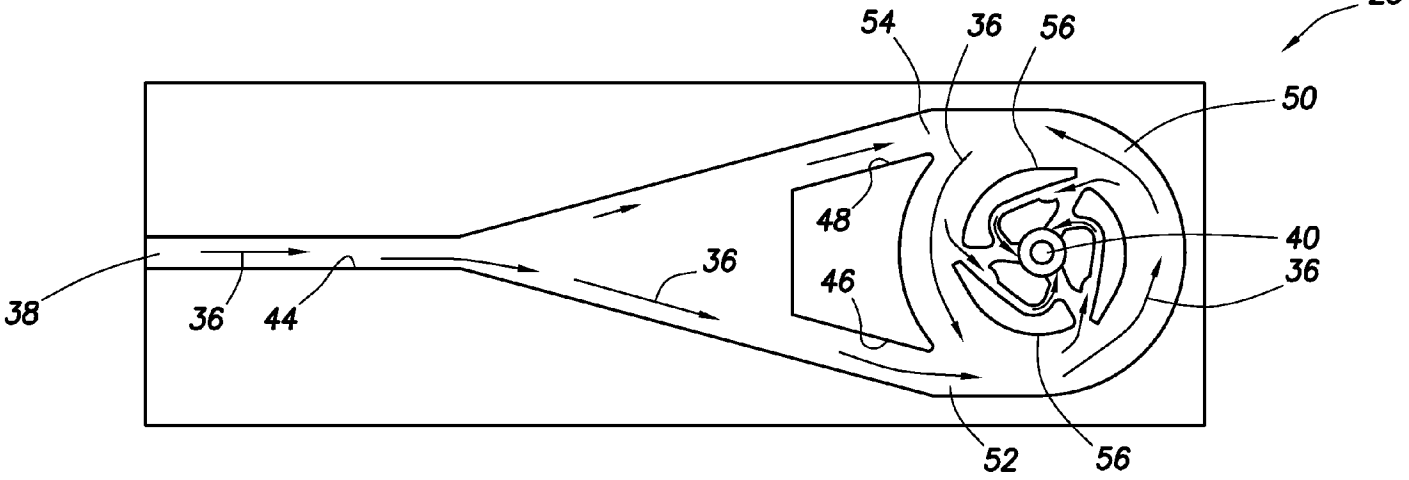
FIG. 4 is a representative cross-sectional view of the variable flow resistance system, with rotational flow in a chamber of the system.

Referring additionally now to FIG. 4, the system 25 is representatively illustrated in another configuration, in which flow resistance through the system is increased, as compared to the configuration of FIG. 3. This increase in flow resistance of the system 25 can be due to a change in a property of the fluid composition 36, due to a change in the configuration of the system 25, etc.

A greater proportion of the fluid composition 36 flows through the flow path 46 and into the chamber 50 via the inlet 52, as compared to the proportion which flows into the chamber via the inlet 54. When a majority of the fluid composition 36 flows into the chamber 50 via the inlet 52, the fluid composition tends to rotate counter-clockwise in the chamber (as viewed in FIG. 4).

The structures 56 are designed to promote such rotational flow in the chamber 50, and as a result, more energy in the fluid composition 36 flow is dissipated. Thus, resistance to flow through the system 25 is increased in the FIG. 4 configuration as compared to the FIG. 3 configuration.

Although in FIGS. 3 & 4 the flow chamber 50 has multiple inlets 52, 54, any number (including one) of inlets may be used in keeping with the scope of this disclosure. For example, in U.S. application Ser. No. 12/792117, filed on 2 Jun. 2010, a flow chamber is described which has only a single inlet, but resistance to flow through the chamber varies depending on via which flow path a majority of a fluid composition enters the chamber.

Figure 5:
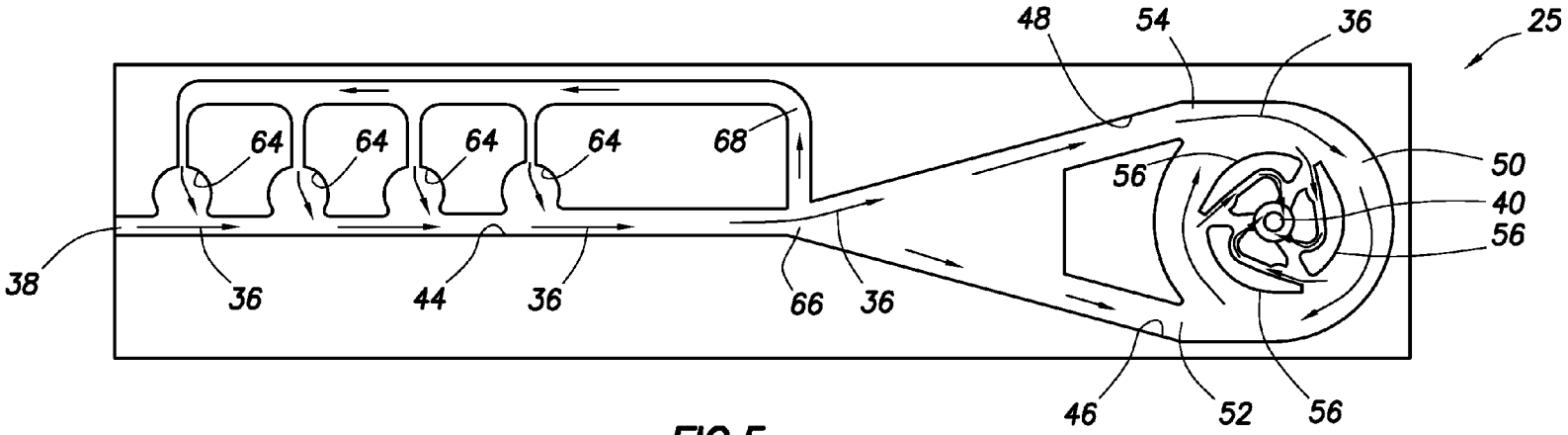
FIGS. 5 & 6 are representative cross-sectional views of another configuration of the variable flow resistance system, resistance to flow being greater in FIG. 5 as compared to FIG. 6.
Figure 6:
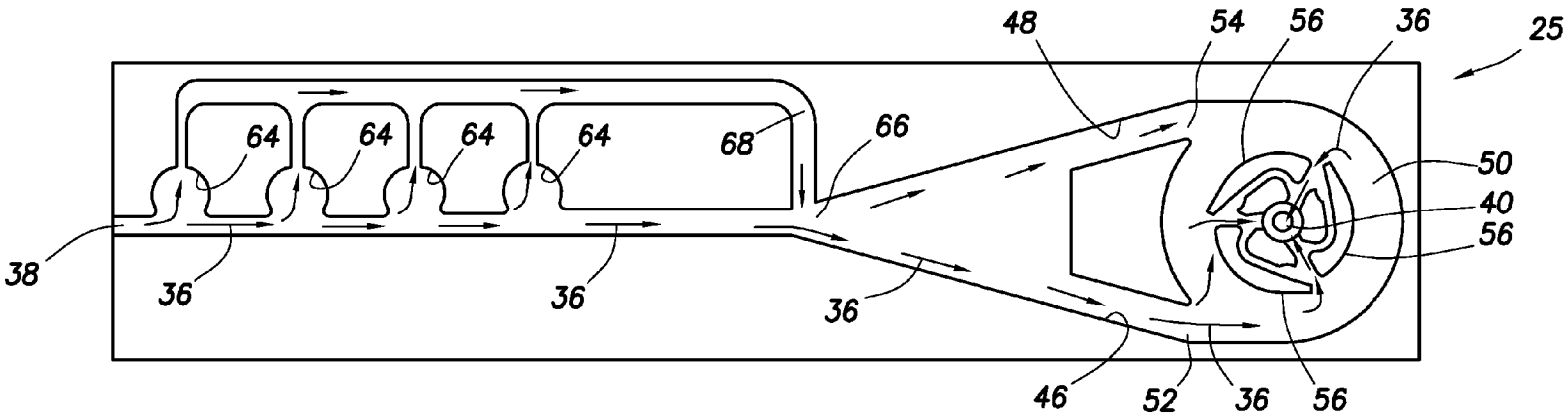

Another configuration of the variable flow resistance system 25 is representatively illustrated in FIGS. 5 & 6. In this configuration, flow resistance through the system 25 can be varied due to a change in a property of the fluid composition 36.

In FIG. 5, the fluid composition 36 has a relatively high velocity. As the fluid composition 36 flows through the passage 44, it passes multiple chambers 64 formed in a side of the passage. Each of the chambers 64 is in communication with a pressure-operated fluid switch 66.

At elevated velocities of the fluid composition 36 in the passage 44, a reduced pressure will be applied to the fluid switch 66 as a result of the fluid composition flowing past the chambers 64, and the fluid composition will be influenced to flow toward the branch flow path 48, as depicted in FIG. 5. A majority of the fluid composition 36 flows into the chamber 50 via the inlet 54, and flow resistance through the system 25 is increased. At lower velocities and increased viscosities, more of the fluid composition 36 will flow into the chamber 50 via the inlet 52, and flow resistance through the system 25 is decreased due to less rotational flow in the chamber.

In FIG. 6, rotational flow of the fluid composition 36 in the chamber 50 is reduced, and the resistance to flow through the system 25 is, thus, also reduced. Note that, if the velocity of the fluid composition 36 in the passage 44 is reduced, or if the viscosity of the fluid composition is increased, a portion of the fluid composition can flow into the chambers 64 and to the fluid switch 66, which influences the fluid composition to flow more toward the flow path 46.

At relatively high velocities, low viscosity and/or high density of the fluid composition 36, a majority of the fluid composition will flow via the flow path 48 to the chamber 50, as depicted in FIG. 5, and such flow will be more restricted. At relatively low velocity, high viscosity and/or low density of the fluid composition 36, a majority of the fluid composition will flow via the flow path 46 to the chamber 50, as depicted in FIG. 6, and such flow will be less restricted.

If oil is a desired fluid and water is an undesired fluid, then it will be appreciated that the system 25 of FIGS. 5 & 6 will result in less resistance to flow of the fluid composition 36 through the system when a ratio of desired to undesired fluid is increased, and greater resistance to flow when the ratio of desired to undesired fluid is decreased. This is due to oil having higher viscosity and less density as compared to water. Due to its higher viscosity, oil also generally flows at a slower velocity as compared to water, for a given pressure differential across the system 25.

However, in other examples, the chamber 50 and structures 56 could be otherwise configured (e.g., reversed from their FIGS. 5 & 6 configuration, as in the FIGS. 3 & 4 configuration), so that flow of a majority of the fluid composition 36 through the flow path 46 is more restricted as compared to flow of a majority of the fluid composition through the flow path 48. An increased ratio of desired to undesired fluid can result in greater or lesser restriction to flow through the system 25, depending on its configuration. Thus, the scope of this disclosure is not limited at all to the details of the specific flow resistance systems 25 described herein.

In the FIGS. 3 & 4 configuration, a majority of the fluid composition 36 will continue to flow via one of the flow paths 46, 48 (due to the Coanda effect), or will flow relatively equally via both flow paths 46, 48, unless the direction of the flow from the passage 44 is changed. In the FIGS. 5 & 6 configuration, the direction of the flow from the passage 44 can be changed by means of the fluid switch 66, which influences the fluid composition 36 to flow toward one of the two flow paths 46, 48. In other examples, greater or fewer numbers of flow paths may be used, if desired.

In the further description below, additional techniques for influencing the direction of flow of the fluid composition 36 through the system 25, and variably resisting the flow of the fluid composition, are described. These techniques may be used in combination with the configurations of FIGS. 3-6, or they may be used with other types of variable flow resistance systems.

Figure 7:
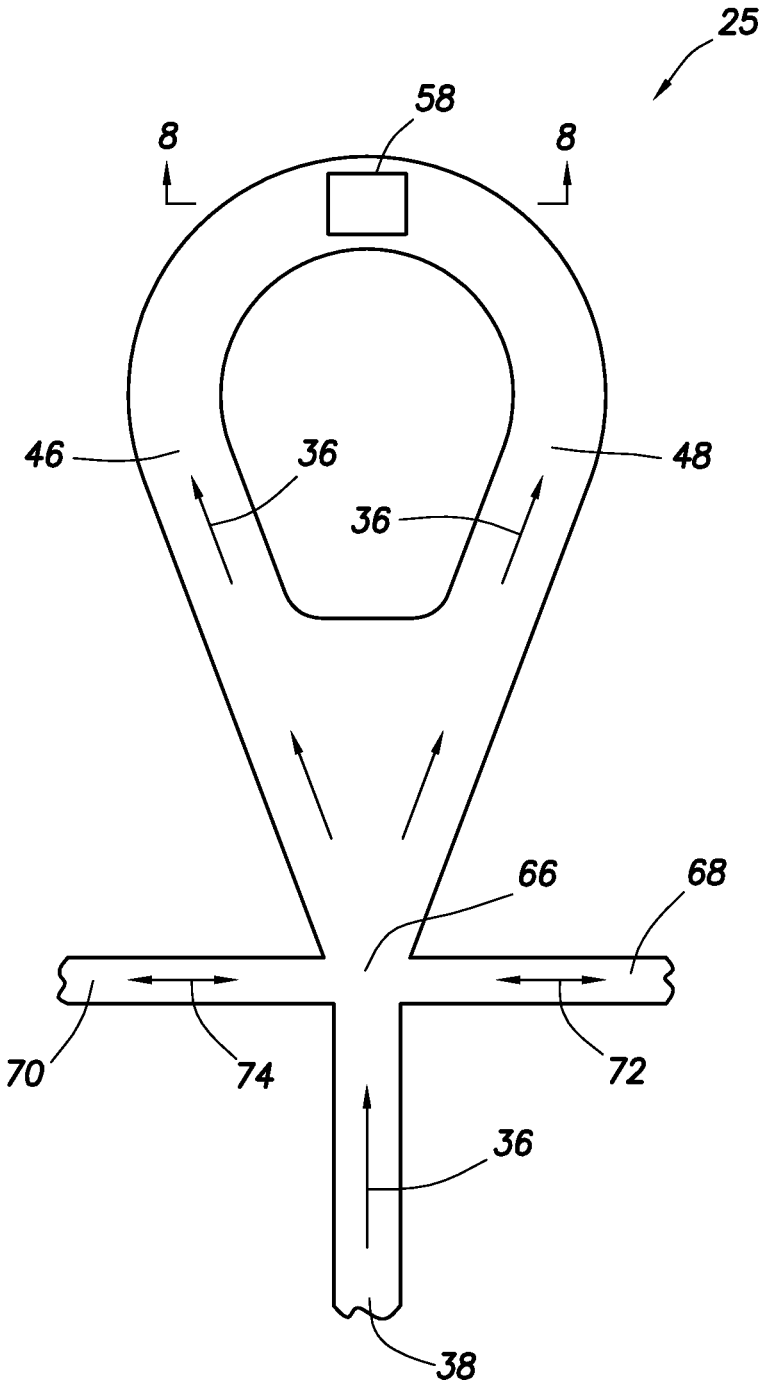
FIG. 7 is a representative cross-sectional view of another configuration of the variable flow resistance system.
Figure 8:
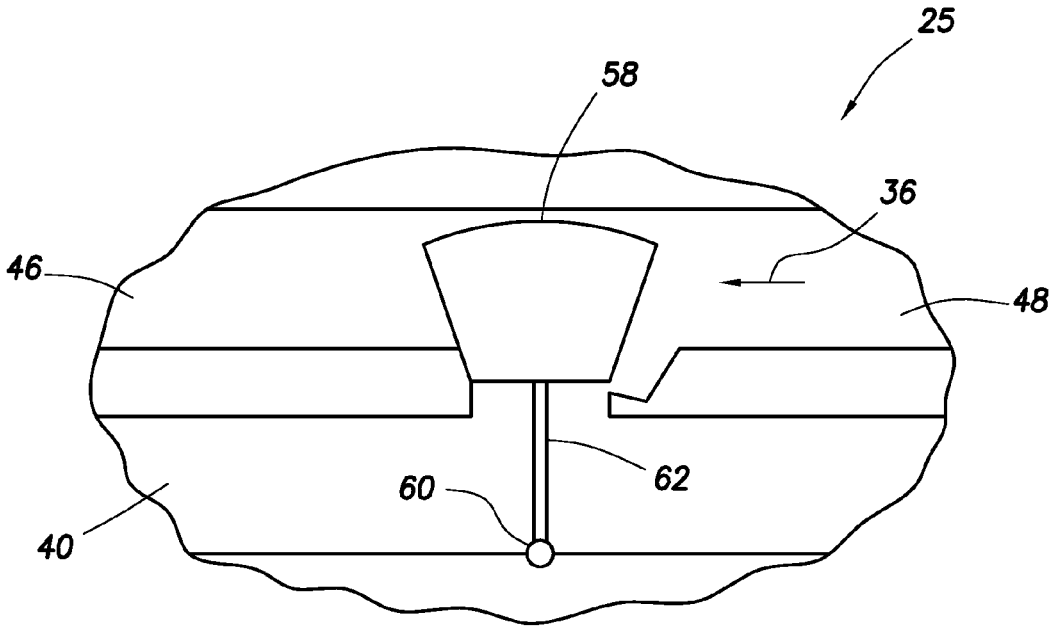
FIG. 8 is a representative cross-sectional view of the FIG. 7 configuration, taken along line 8-8.
Figure 9:
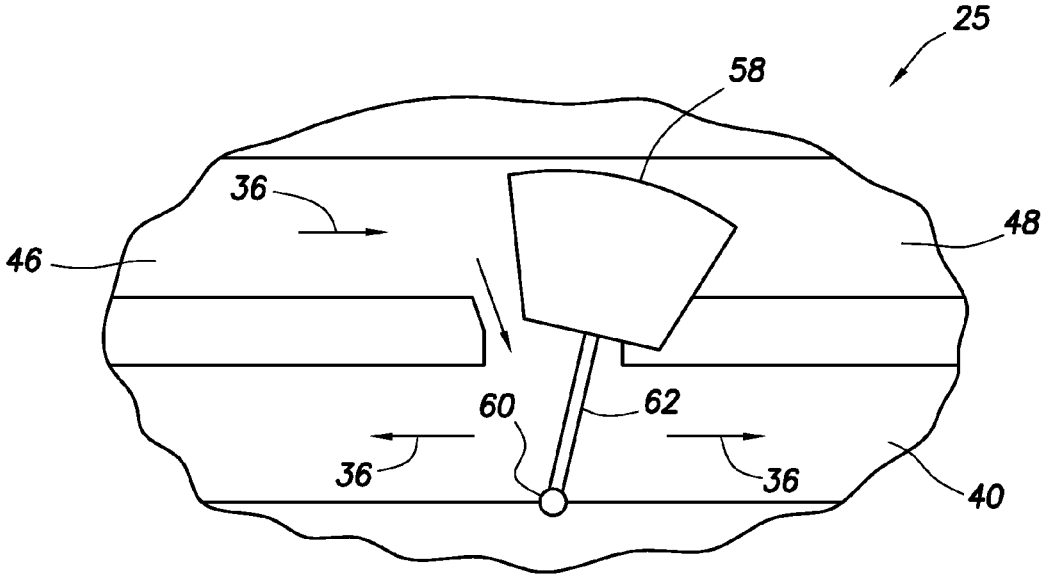
FIG. 9 is a representative cross-sectional view of the variable flow resistance system, resistance to flow being greater in FIG. 8 as compared to that in FIG. 9.

Referring additionally now to FIGS. 7-9, another configuration of the variable flow resistance system 25 is representatively illustrated. This configuration is similar in some respects to the configuration of FIGS. 3-6, however, instead of the flow chamber 50, the configuration of FIGS. 7-9 uses a structure 58 which displaces in response to a change in a proportion of the fluid composition 36 which flows through the flow paths 46, 48 (that is, a ratio of the fluid composition which flows through one flow path and the fluid composition which flows through the other flow path).

For example, in FIG. 8, a majority of the fluid composition 36 flows via the flow path 48, and this flow impinging on the structure 58 causes the structure to displace to a position in which such flow is increasingly restricted. Note that, in FIG. 8, the structure 58 itself almost completely blocks the fluid composition 36 from flowing to the outlet 40.

In FIG. 9, a majority of the fluid composition 36 flows via the flow path 46 and, in response, the structure 58 displaces to a position in which flow restriction in the system 25 is reduced. The structure 58 does not block the flow of the fluid composition 36 to the outlet 40 in FIG. 9 as much as it does in FIG. 8.

In other examples, the structure 58 itself may not block the flow of the fluid composition 36, and the structure could be biased toward the FIG. 8 and/or FIG. 9 position (e.g., using springs, compressed gas, other biasing devices, etc.), thereby changing the proportion of the fluid composition 36 which must flow through a particular flow path 46, 48, in order to displace the structure. Preferably, the fluid composition 36 does not have to exclusively flow through only one of the flow paths 46, 48 in order to displace the structure 58 to a particular position, but such a design could be implemented, if desired.

The structure 58 is mounted via a connection 60. Preferably, the connection 60 serves to secure the structure 58, and also to resist a pressure differential applied across the structure from the flow paths 46, 48 to the outlet 40. When the fluid composition 36 is flowing through the system 25, this pressure differential can exist, and the connection 60 can resist the resulting forces applied to the structure 58, while still permitting the structure to displace freely in response to a change in the proportion of the flow via the flow paths 46, 48.

In the FIGS. 8 & 9 example, the connection 60 is depicted as a pivoting or rotational connection. However, in other examples, the connection 60 could be a rigid, sliding, translating, or other type of connection, thereby allowing for displacement of the structure 58 in any of circumferential, axial, longitudinal, lateral, radial, etc., directions.

In one example, the connection 60 could be a rigid connection, with a flexible beam 62 extending between the connection and the structure 58. The beam 62 could flex, instead of the connection 60 rotating, in order to allow the structure 58 to displace, and to provide a biasing force toward the more restricting position of FIG. 8, toward the less restricting position of FIG. 9, or toward any other position (e.g., a position between the more restricting and less restricting positions, etc.).

Another difference of the FIGS. 7-9 configuration and the configurations of FIGS. 3-6 is that the FIGS. 7-9 configuration utilizes the fluid switch 66 with multiple control passages 68, 70. In comparison, the FIGS. 3 & 4 configuration does not have a controlled fluid switch, and the FIGS. 5 & 6 configuration utilizes the fluid switch 66 with a single control passage 68. However, it should be understood that any fluid switch and any number of control passages can be used with any variable flow resistance system 25 configuration, in keeping with the scope of this disclosure.

As depicted in FIG. 7, the fluid switch 66 directs the fluid composition 36 flow toward the flow path 46 when flow 72 through the control passage 68 is toward the fluid switch, and/or when flow 74 in the control passage 70 is away from the fluid switch. The fluid switch 66 directs the fluid composition 36 flow toward the flow path 48 when flow 72 through the control passage 68 is away from the fluid switch, and/or when flow 74 in the control passage 70 is toward the fluid switch.

Thus, since the proportion of the fluid composition 36 which flows through the flow paths 46, 48 can be changed by the fluid switch 66, in response to the flows 72, 74 through the control passages 68, 70, it follows that the resistance to flow of the fluid composition 36 through the system 25 can be changed by changing the flows through the control passages. For this purpose, the control passages 68, 70 may be connected to any of a variety of devices for influencing the flows 72, 74 through the control passages.

For example, the chambers 64 of the FIGS. 5 & 6 configuration could be connected to the control passage 68 or 70, and another set of chambers, or another device could be connected to the other control passage. The flows 72, 74 through the control passages 68, 70 could be automatically changed (e.g., using the chambers 64, etc.) in response to changes in one or more properties (such as density, viscosity, velocity, etc.) of the fluid composition 36, the flows could be controlled locally (e.g., in response to sensor measurements, etc.), or the flows could be controlled remotely (e.g., from the earth's surface, another remote location, etc.). Any technique for controlling the flows 72, 74 through the control passages 68, 70 may be used, in keeping with the scope of this disclosure.

Preferably, the flow 72 is toward the fluid switch 66, and/or the flow 74 is away from the fluid switch, when the fluid composition 36 has an increased ratio of desired to undesired fluids, so that more of the fluid composition will be directed by the fluid switch to flow toward the flow path 46, thereby reducing the resistance to flow through the system 25. Conversely, the flow 72 is preferably away from the fluid switch 66, and/or the flow 74 is preferably toward the fluid switch, when the fluid composition 36 has a decreased ratio of desired to undesired fluids, so that more of the fluid composition will be directed by the fluid switch to flow toward the flow path 48, thereby increasing the resistance to flow through the system 25.

Figure 10:
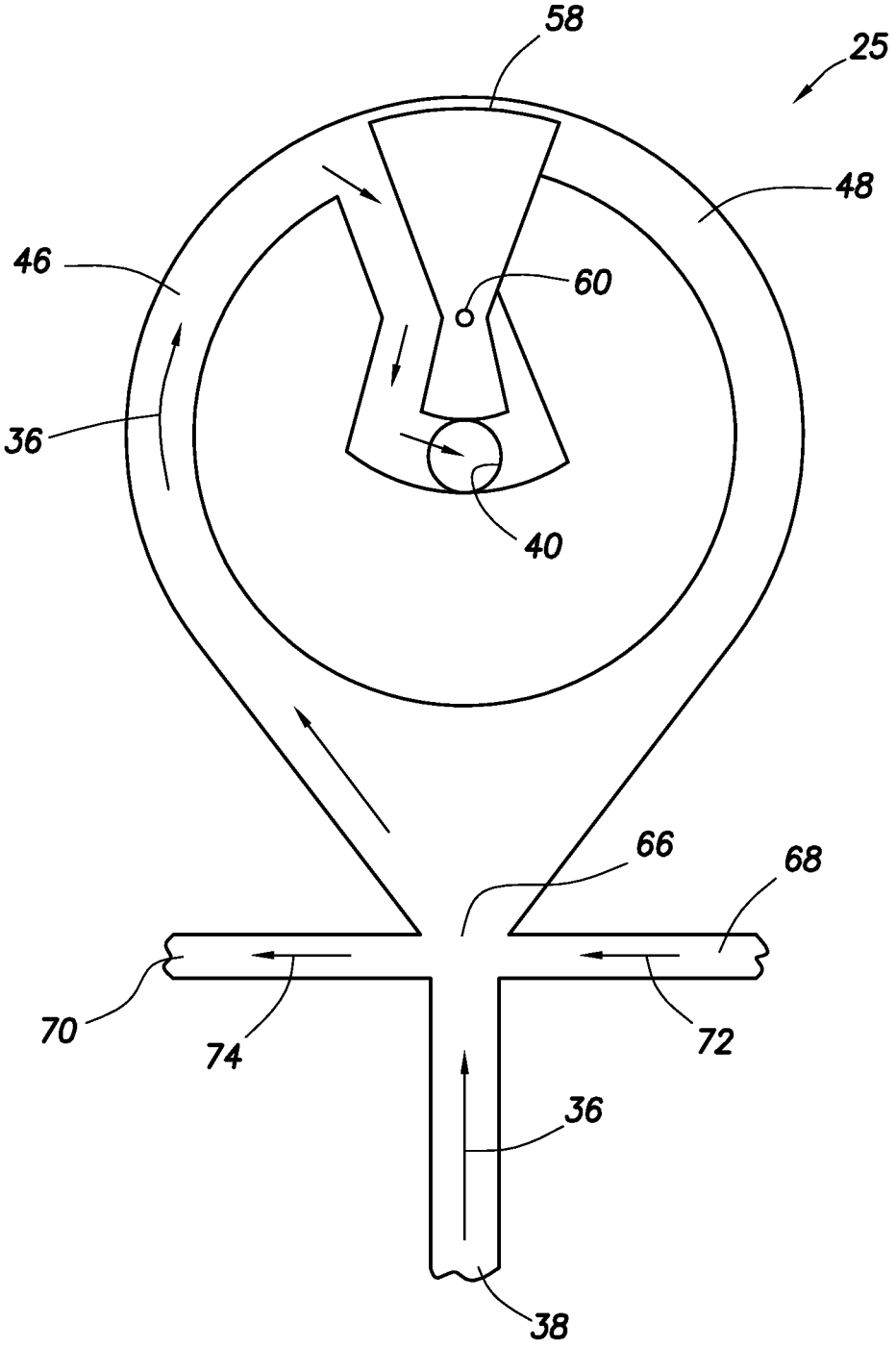
FIGS. 10 & 11 are representative cross-sectional views of another configuration of the variable flow resistance system, resistance to flow being greater in FIG. 11 as compared to that in FIG. 10.
Figure 11:
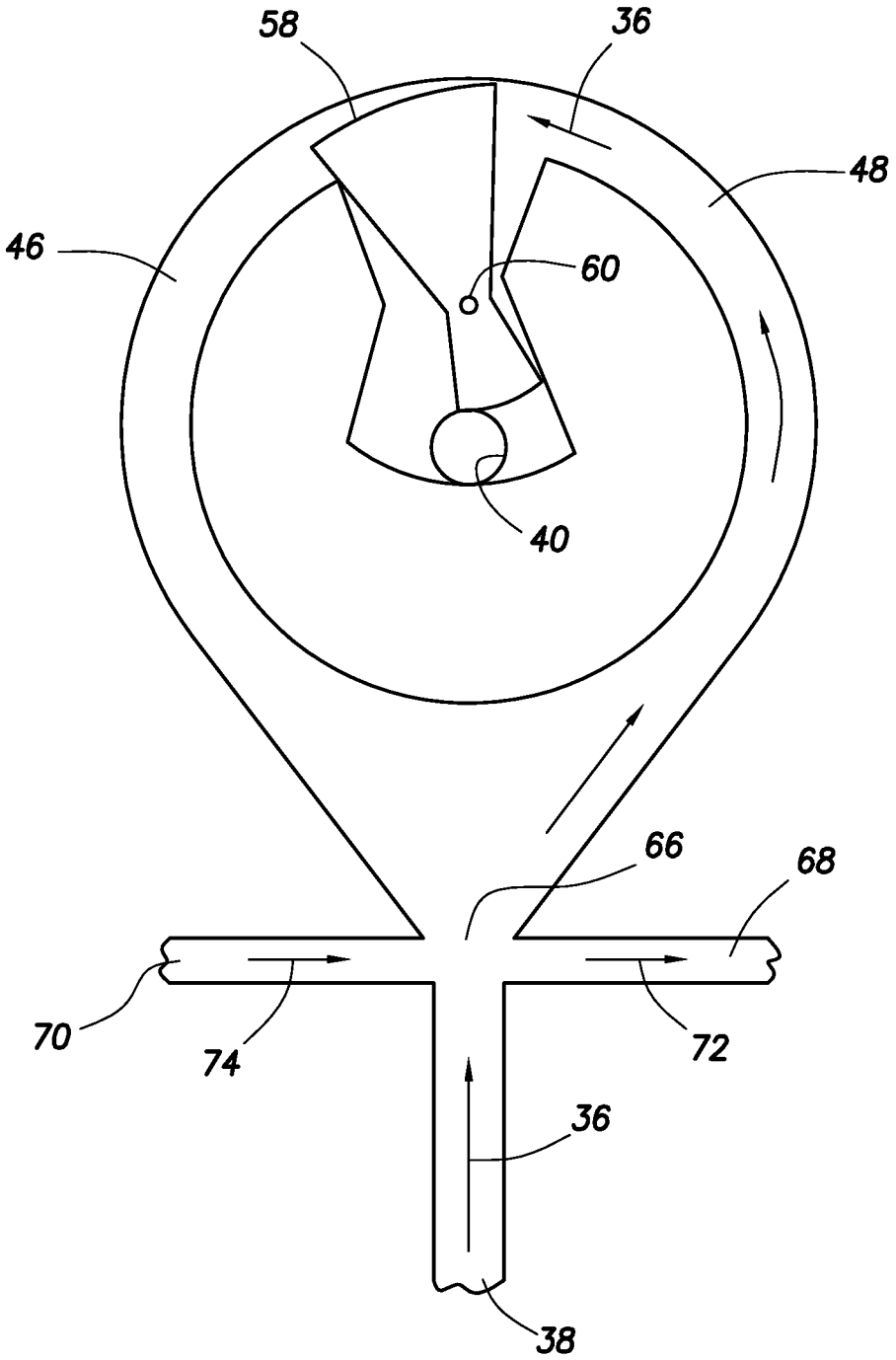

Referring additionally now to FIGS. 10 & 11, another configuration of the variable flow resistance system 25 is representatively illustrated. In this configuration, the structure 58 rotates about the connection 60, in order to change between a less restricted flow position (FIG. 10) and a more restricted flow position (FIG. 11).

As in the configuration of FIGS. 7-9, the configuration of FIGS. 10 & 11 has the structure 58 exposed to flow in both of the flow paths 46, 48. Depending on a proportion of these flows, the structure 58 can displace to either of the FIGS. 10 & 11 positions (or to any position in-between those positions). The structure 58 in the FIGS. 7-11 configurations can be biased toward any position, or releasably retained at any position, in order to adjust the proportion of flows through the flow paths 46, 48 needed to displace the structure to another position.

Figure 12:
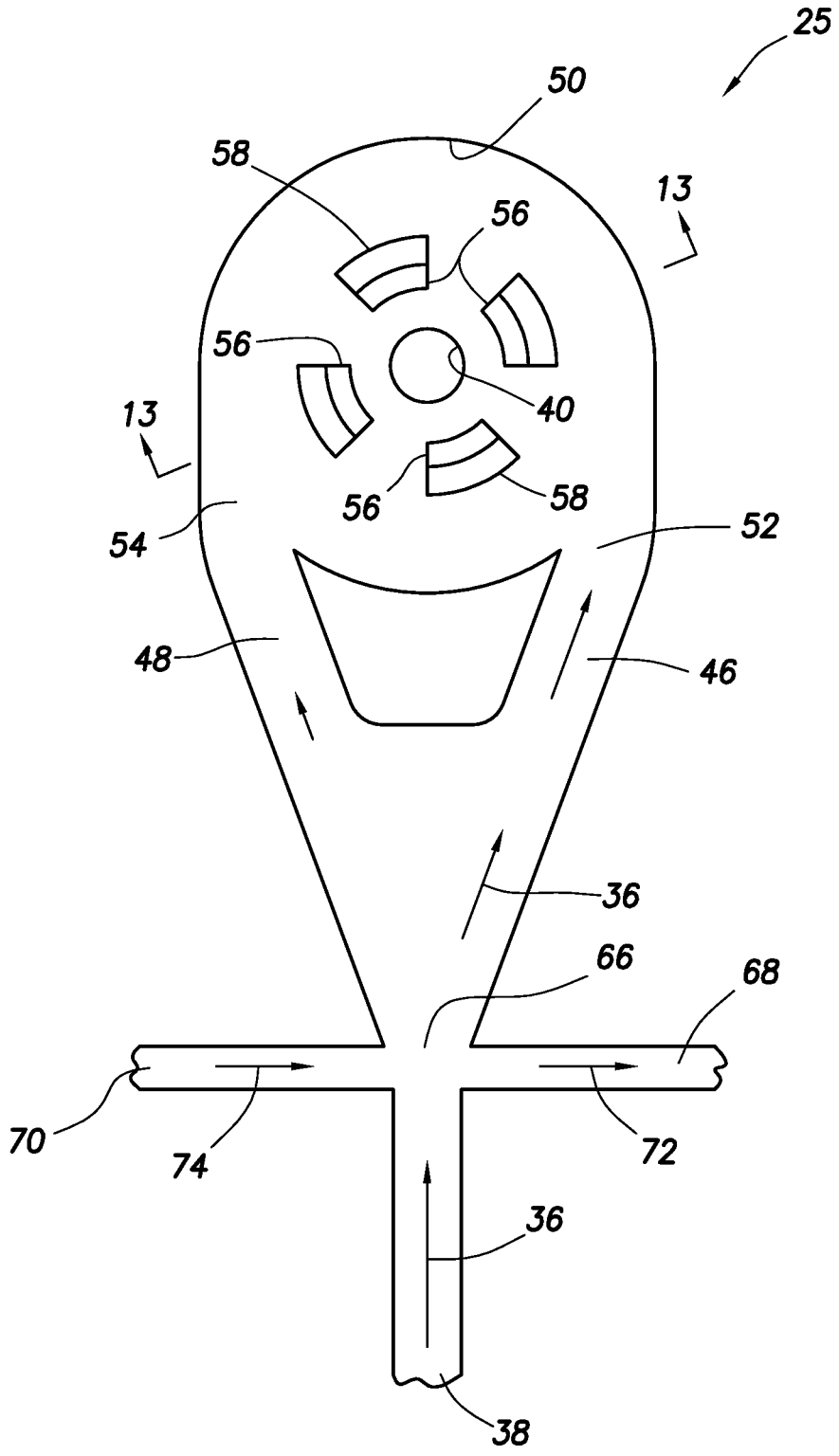
FIG. 12 is a representative cross-sectional view of another configuration of the variable flow resistance system.

Referring additionally now to FIGS. 12 & 13, another configuration of the variable flow resistance system 25 is representatively illustrated. In this configuration, the structure 58 is positioned in the flow chamber 50 connected to the flow paths 46, 48.

In the FIGS. 12 & 13 example, a majority of the flow of the fluid composition 36 through the flow path 46 results in the structure 58 rotating about the connection 60 to a position in which flow between the structures 56 (the structures comprising circumferentially extending vanes in this example) is not blocked by the structure 58. However, if a majority of the flow is through the flow path 48 to the flow chamber 50, the structure 58 will rotate to a position in which the structure 58 does substantially block the flow between the structures 56, thereby increasing the flow resistance.

Referring additionally now to FIG. 14, another configuration of the variable flow resistance system 25 is representatively illustrated. In this example, the flow path 46 connects to the chamber 50 in more of a radial, rather than a tangential) direction, as compared to the configuration of FIGS. 12 & 13.

In addition, the structures 56, 58 are spaced to allow relatively direct flow of the fluid composition 36 from the inlet 54 to the outlet 40. This configuration can be especially beneficial where the fluid composition 36 is directed by the fluid switch 66 toward the flow path 46 when the fluid composition has an increased ratio of desired to undesired fluids therein.

In this example, an increased proportion of the fluid composition 36 flowing through the flow path 48 will cause the flow to be more rotational in the chamber 50, thereby dissipating more energy and increasingly restricting the flow, and will cause the structure 58 to rotate to a position in which flow between the structures 56 is more restricted. This situation preferably occurs when the ratio of desired to undesired fluids in the fluid composition 36 decreases.

Figure 16:
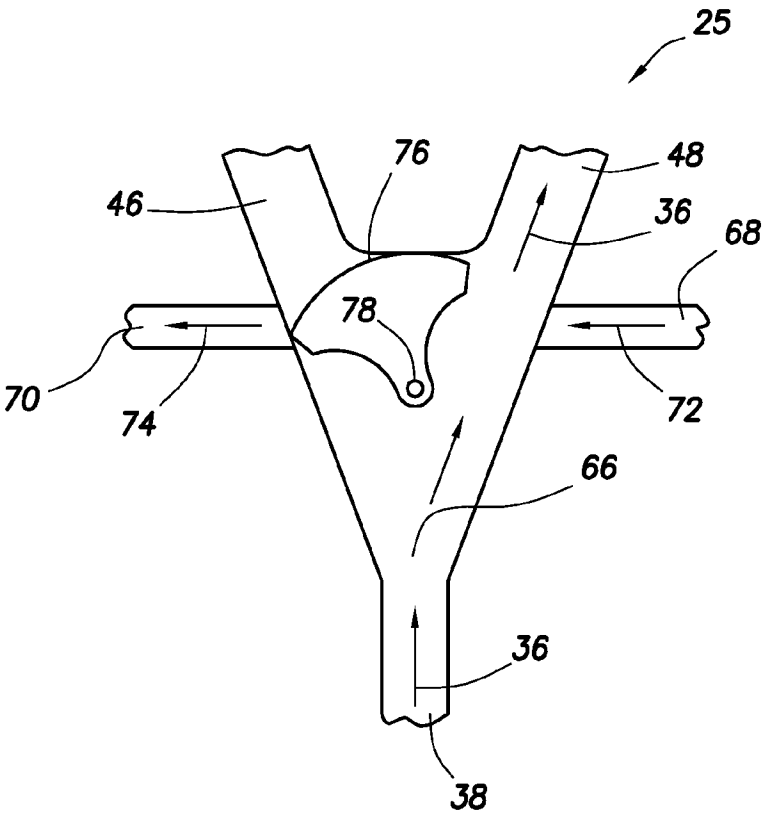
FIGS. 15 & 16 are representative cross-sectional views of a fluid switch configuration which may be used with the variable flow resistance system.
Figure 15:
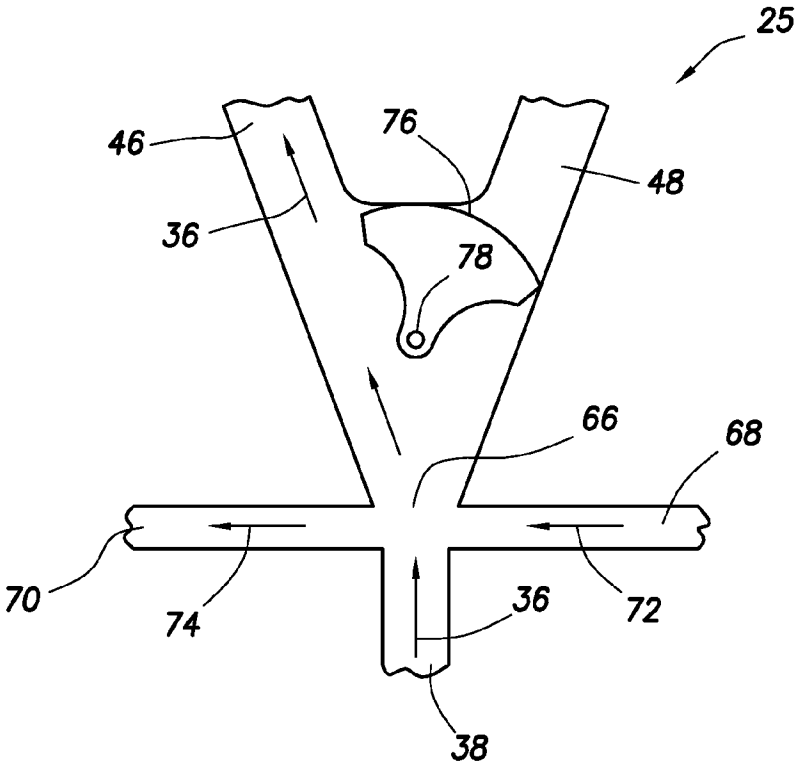

Referring additionally now to FIGS. 15 & 16, additional configurations of the fluid switch 66 are representatively illustrated. The fluid switch 66 in these configurations has a blocking device 76 which rotates about a connection 78 to increasingly block flow through one of the flow paths 46, 48 when the fluid switch directs the flow toward the other flow path. These fluid switch 66 configurations may be used in any system 25 configuration.

In the FIG. 15 example, either or both of the control passage flows 72, 74 influence the fluid composition 36 to flow toward the flow path 46. Due to this flow toward the flow path 46 impinging on the blocking device 76, the blocking device rotates to a position in which the other flow path 48 is completely or partially blocked, thereby influencing an even greater proportion of the fluid composition to flow via the flow path 46, and not via the flow path 48. However, if either or both of the control passage flows 72, 74 influence the fluid composition 36 to flow toward the flow path 48, this flow impinging on the blocking device 76 will rotate the blocking device to a position in which the other flow path 46 is completely or partially blocked, thereby influencing an even greater proportion of the fluid composition to flow via the flow path 48, and not via the flow path 46.

In the FIG. 16 example, either or both of the control passage flows 72, 74 influence the blocking device 76 to increasingly block one of the flow paths 46, 48. Thus, an increased proportion of the fluid composition 36 will flow through the flow path 46, 48 which is less blocked by the device 76. When either or both of the flows 72, 74 influence the blocking device 76 to increasingly block the flow path 46, the blocking device rotates to a position in which the other flow path 48 is not blocked, thereby influencing a greater proportion of the fluid composition to flow via the flow path 48, and not via the flow path 46. However, if either or both of the control passage flows 72, 74 influence the blocking device 76 to rotate toward the flow path 48, the other flow path 46 will not be blocked, and a greater proportion of the fluid composition 36 will flow via the flow path 46, and not via the flow path 48.

By increasing the proportion of the fluid composition 36 which flows through the flow path 46 or 48, operation of the system 25 is made more efficient. For example, resistance to flow through the system 25 can be readily increased when an unacceptably low ratio of desired to undesired fluids exists in the fluid composition 36, and resistance to flow through the system can be readily decreased when the fluid composition has a relatively high ratio of desired to undesired fluids.

Figure 17:
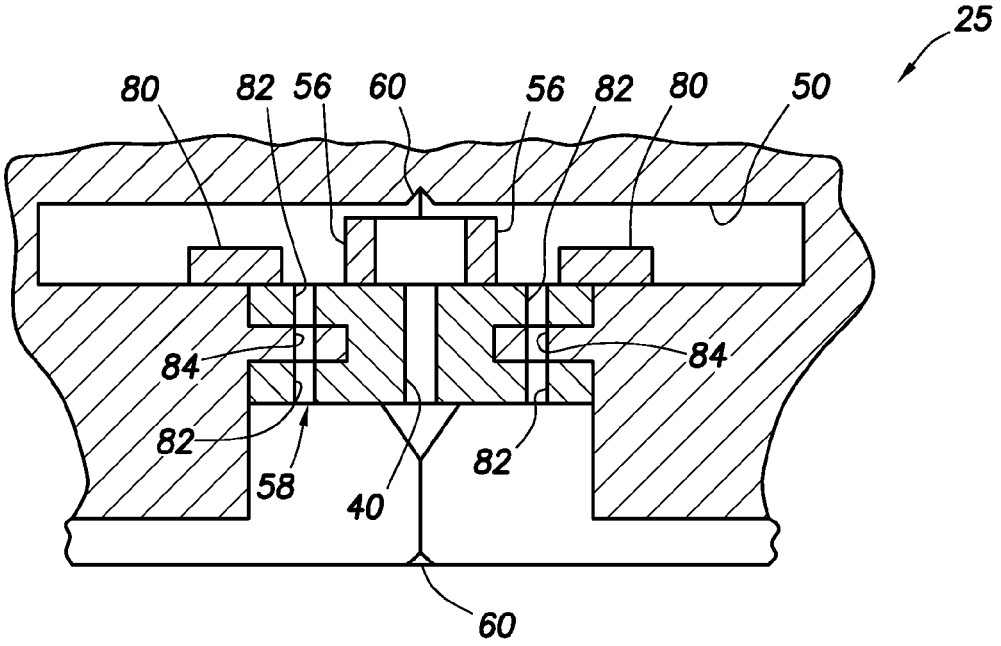
FIGS. 17 & 18 are representative cross-sectional views of another configuration of the variable flow resistance system, FIG. 17 being taken along line 17-17 of FIG. 18.
Figure 18:
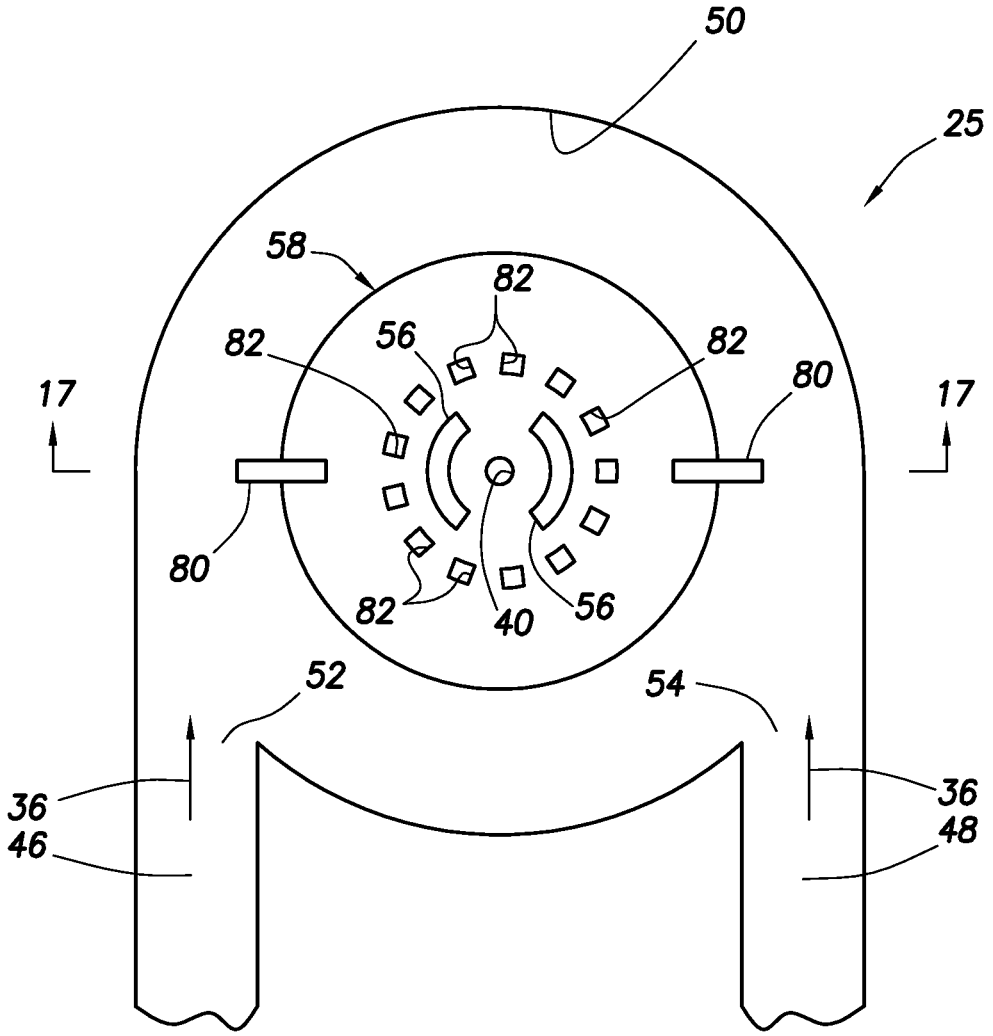

Referring additionally now to FIGS. 17 & 18, another configuration of the system 25 is representatively illustrated. This configuration is similar in some respects to the configuration of FIGS. 12 & 13, in that the structure 58 rotates in the chamber 50 in order to change the resistance to flow. The direction of rotation of the structure 58 depends on through which of the flow paths 46 or 48 a greater proportion of the fluid composition 36 flows.

In the FIGS. 17 & 18 example, the structure 58 includes vanes 80 on which the fluid composition 36 impinges. Thus, rotational flow in the chamber 50 impinges on the vanes 80 and biases the structure 58 to rotate in the chamber.

When the structure 58 is in the position depicted in FIGS. 17 & 18, openings 82 align with openings 84, and the structure does not substantially block flow from the chamber 50. However, if the structure 58 rotates to a position in which the openings 82, 84 are misaligned, then the structure will increasingly block flow from the chamber 50 and resistance to flow will be increased.

Although in certain examples described above, the structure 58 displaces by pivoting or rotating, it will be appreciated that the structure could be suitably designed to displace in any direction to thereby change the flow resistance through the system 25. In various examples, the structure 58 could displace in circumferential, axial, longitudinal, lateral and/or radial directions.

Figure 19:
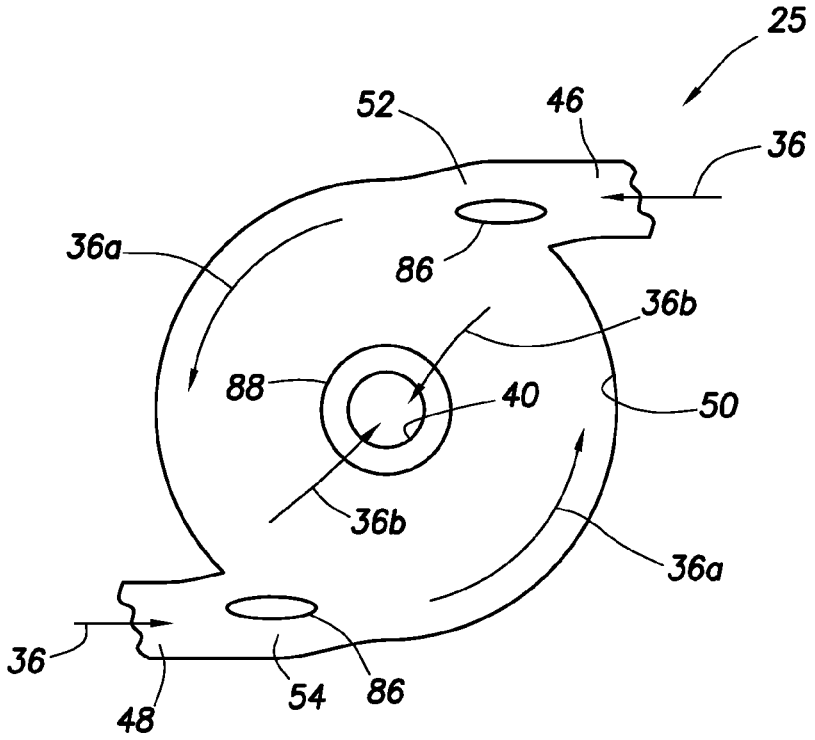
FIG. 19 is a representative cross-sectional view of a flow chamber which may be used with the variable flow resistance system.

Referring additionally now to FIG. 19, another configuration of the chamber 50 is representatively illustrated. The FIG. 19 chamber 50 may be used with any configuration of the system 25.

One difference between the FIG. 19 chamber 50 and the other chambers described herein is that a swellable material 86 is provided at the inlets 52, 54 to the chamber, and a swellable material 88 is provided about the outlet 40. Preferably, the swellable materials 86, 88 swell in response to contact with an undesirable fluids (such as water or gas, etc.) and do not swell in response to contact with desirable fluids (such as liquid hydrocarbons, gas, etc.). However, in other examples, the materials 86, 88 could swell in response to contact with desirable fluids.

In the FIG. 19 example, the swellable materials 86 at the inlets 52, 54 are shaped like vanes or airfoils, so that the fluid composition 36 is influenced to flow more rotationally (as indicated by arrows 36*a*) through the chamber 50, instead of more radially (as indicated by arrows 36*b*), when the material swells. Since more energy is dissipated when there is more rotational flow in the chamber 50, this results in more resistance to flow through the system 25.

The swellable material 88 is positioned about the outlet 40 so that, as the ratio of desired to undesired fluid in the fluid composition 36 decreases, the material will swell and thereby increasingly restrict flow through the outlet. Thus, the swellable material 88 can increasingly block flow through the system 25, in response to contact with the undesired fluid.

It will be appreciated that the swellable materials 86 change the direction of flow of the fluid composition 36 through the chamber 50 to thereby change the flow resistance, and the swellable material 88 selectively blocks flow through the system to thereby change the flow resistance. In other examples, the swellable materials 86 could change the direction of flow at locations other than the inlets 52, 54, and the swellable material 88 can block flow at locations other than the outlet 40, in keeping with the scope of this disclosure.

The swellable materials 86, 88 in the FIG. 19 example allow for flow resistance to be increased as the ratio of desired to undesired fluid in the fluid composition 36 decreases. However, in other examples, the swellable materials 86, 88 could swell in response to contact with a desired fluid, or the flow resistance through the system 25 could be decreased as the ratio of desired to undesired fluid in the fluid composition 36 decreases.

The term "swell" and similar terms (such as "swellable") are used herein to indicate an increase in volume of a swellable material. Typically, this increase in volume is due to incorporation of molecular components of an activating agent into the swellable material itself, but other swelling mechanisms or techniques may be used, if desired. Note that swelling is not the same as expanding, although a material may expand as a result of swelling.

The activating agent which causes swelling of the swellable material can be a hydrocarbon fluid (such as oil or gas, etc.), or a non-hydrocarbon fluid (such as water or steam, etc.). In the well system 10, the swellable material may swell when the fluid composition 36 comprises the activating agent (e.g., when the activating agent enters the wellbore 12 from the formation 20 surrounding the wellbore, when the activating agent is circulated to the system 25, or when the activating agent is released downhole, etc.). In response, the swellable materials 86, 88 swell and thereby change the flow resistance through the system 25.

The activating agent which causes swelling of the swellable material could be comprised in any type of fluid. The activating agent could be naturally present in the well, or it could be conveyed with the system 25, conveyed separately or flowed into contact with the swellable material in the well when desired. Any manner of contacting the activating agent with the swellable material may be used in keeping with the scope of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material may have a substantial portion of cavities therein which are compressed or collapsed at surface conditions. Then, after being placed in the well at a higher pressure, the material swells by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

The swellable material used in the system 25 may swell by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

The swellable material could swell due to the presence of ions in a fluid. For example, polymer hydrogels will swell due to changes in the pH of a fluid, which is a measure of the hydrogen ions in the fluid (or, equivalently, the concentration of hydroxide, OH, ions in the fluid). Swelling as a result of the salt ions in the fluid is also possible. Such a swellable material could swell depending on a concentration of chloride, sodium, calcium, and/or potassium ions in the fluid.

It should, thus, be clearly understood that any swellable material which swells when contacted by a predetermined activating agent may be used in keeping with the scope of this disclosure. The swellable material could also swell in response to contact with any of multiple activating agents. For example, the swellable material could swell when contacted by hydrocarbon fluid and/or when contacted by water and/or when contacted by certain ions.

Referring additionally now to FIGS. 20-27, additional configurations of the fluid switch 66 are representatively illustrated. These fluid switch 66 configurations may be used with any configuration of the system 25.

Figure 20:
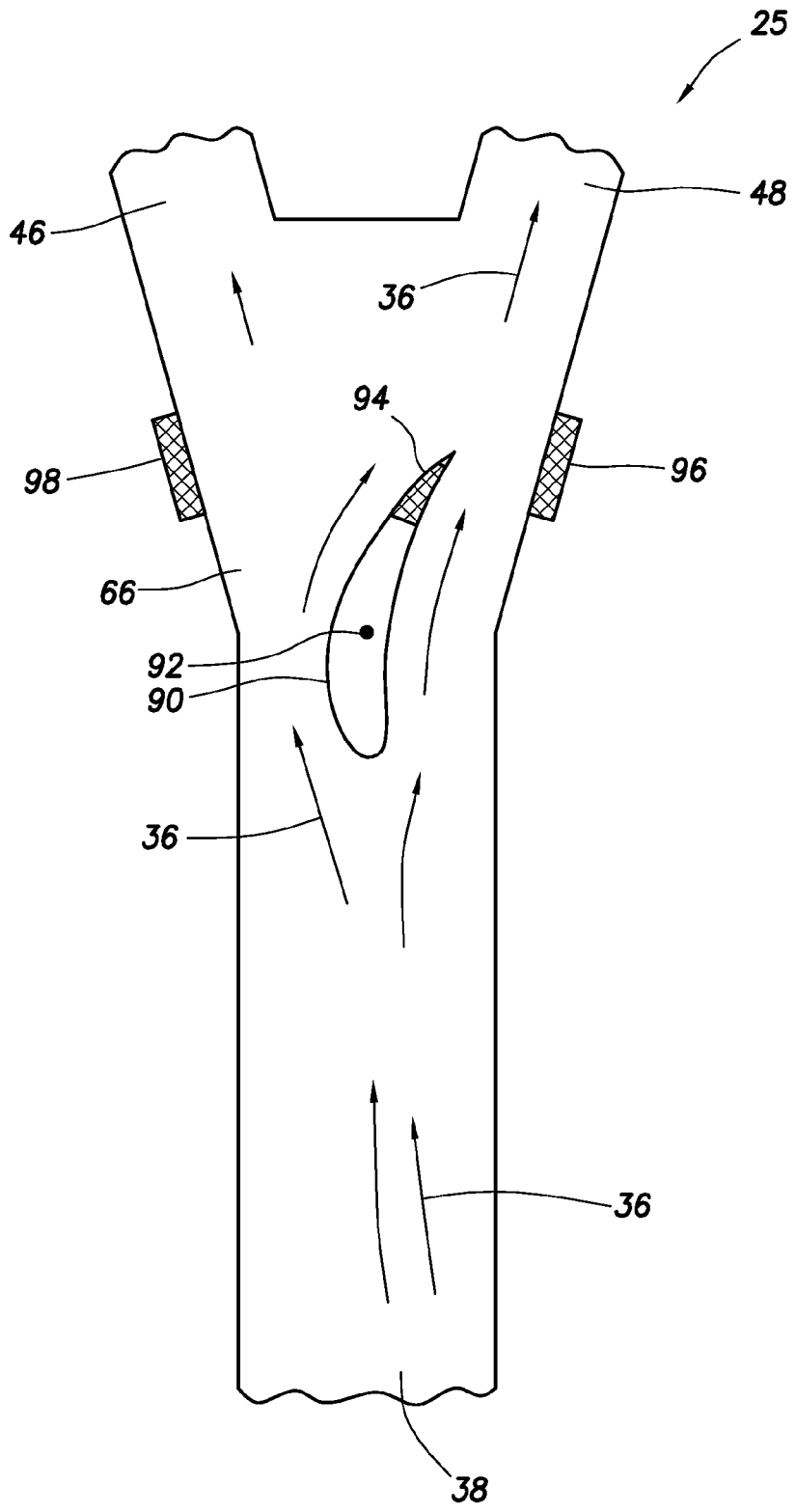
FIGS. 20-27 are representative cross-sectional views of additional fluid switch configurations which may be used with the variable flow resistance system.

In the FIG. 20 example, the fluid switch 66 includes an airfoil 90. The airfoil 90 rotates about a pivot connection 92. Preferably, the airfoil 90 is biased (for example, using a torsion spring, magnetic biasing devices, actuator, etc.), so that it initially directs flow of the fluid composition 36 toward one of the flow paths 46, 48. In FIG. 20, the airfoil 90 is positioned to direct the fluid composition 36 toward the flow path 48.

It will be appreciated by those skilled in the art that, as the velocity of the flow increases, a lift produced by the airfoil 90 also increases, and eventually can overcome the biasing force applied to the airfoil, allowing the airfoil to pivot about the connection 92 to a position in which the airfoil directs the fluid composition 36 toward the other flow path 46. The lift produced by the airfoil 90 can also vary depending on other properties of the fluid composition 36 (e.g., density, viscosity, etc.).

Thus, the airfoil 90 allows the fluid switch 66 to be operated automatically, in response to changes in the properties of the fluid composition 36. Instead of the magnetic biasing device 94, the airfoil 90 itself could be made of a magnetic material.

The magnetic biasing devices 94, 96, 98 can be used to bias the airfoil 90 toward either or both of the positions in which the airfoil directs the fluid composition 36 toward the flow paths 46, 48. The magnetic biasing devices 96, 98 could be positioned further upstream or downstream from their illustrated positions, and they can extend into the flow paths 46, 48, if desired. The magnetic biasing devices 94, 96, 98 (or other types of biasing devices) may be used to bias the airfoil 90 toward any position, in keeping with the scope of this disclosure.

Figure 21:
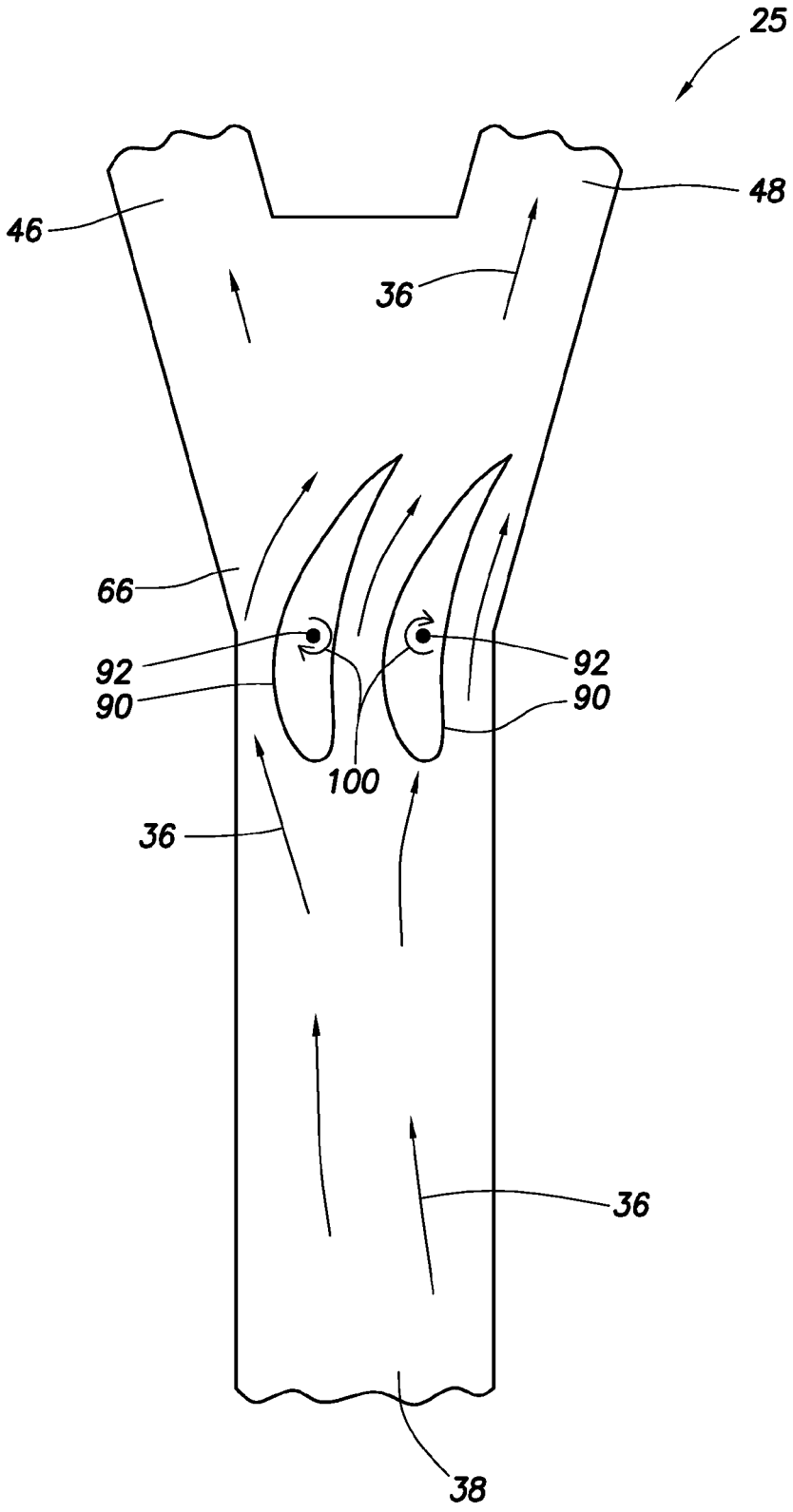

In the configuration of FIG. 21, multiple airfoils 90 are used. As illustrated, two of the airfoils 90 are used, but it will be appreciated that any number of airfoils could be used in other examples.

The airfoils 90 may be constrained to pivot together (e.g., with a mechanical linkage, synchronized stepper motors, etc.), or the airfoils may be permitted to pivot independently of each other. As depicted in FIG. 21, a torsional biasing force 100 is applied to each of the airfoils 90. This biasing force 100 could be applied by any suitable means, such as, one or more rotary actuators, torsion springs, biasing devices 96, 98, etc.).

Figure 22:
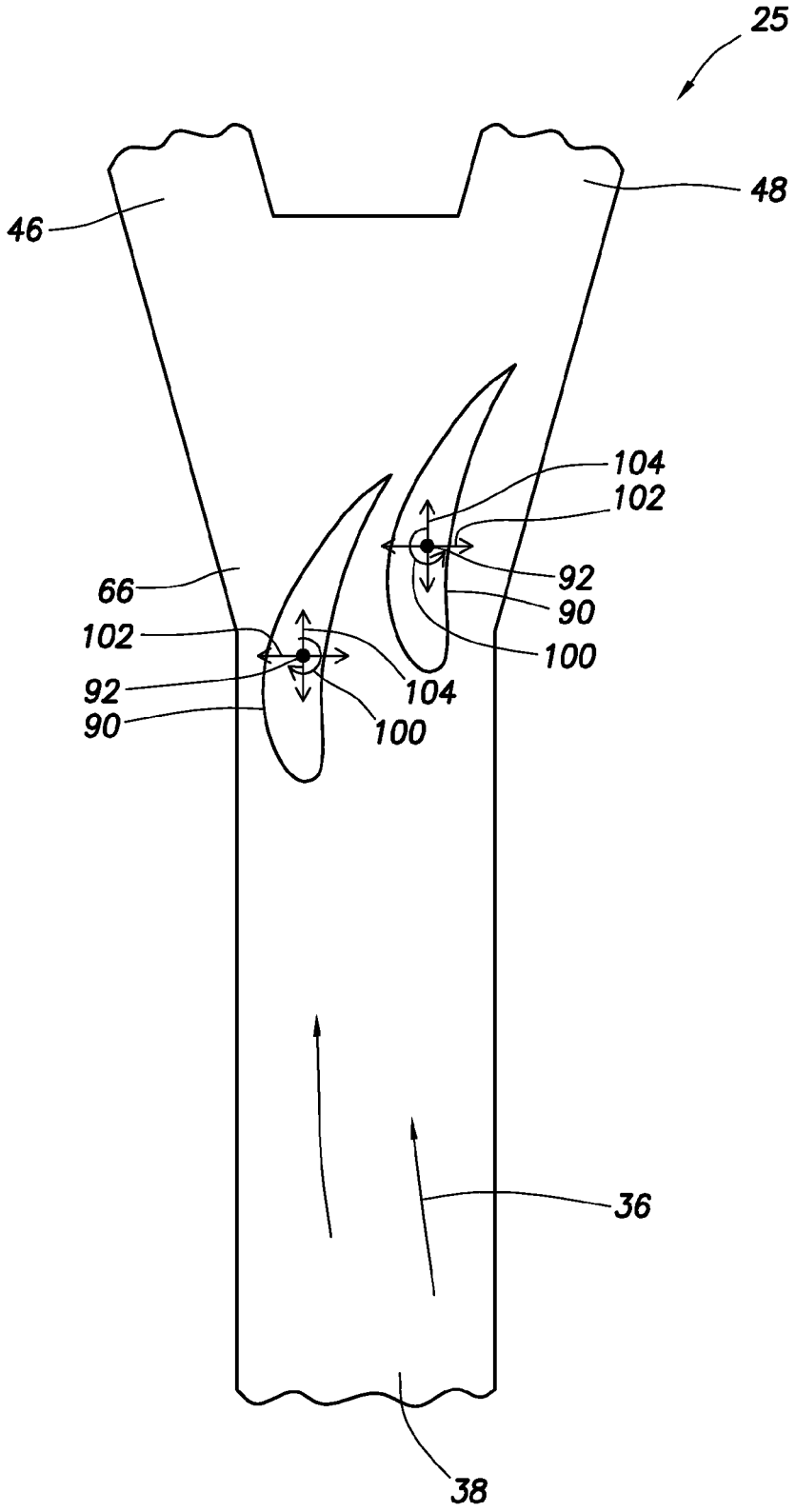

In the configuration of FIG. 22, the multiple airfoils 90 are both laterally and longitudinally spaced apart from each other. In addition, the airfoils 90 can be displaced in both lateral and longitudinal directions 102, 104 (e.g., using linear actuators, etc.), in order to position the airfoils as desired.

Figure 23:
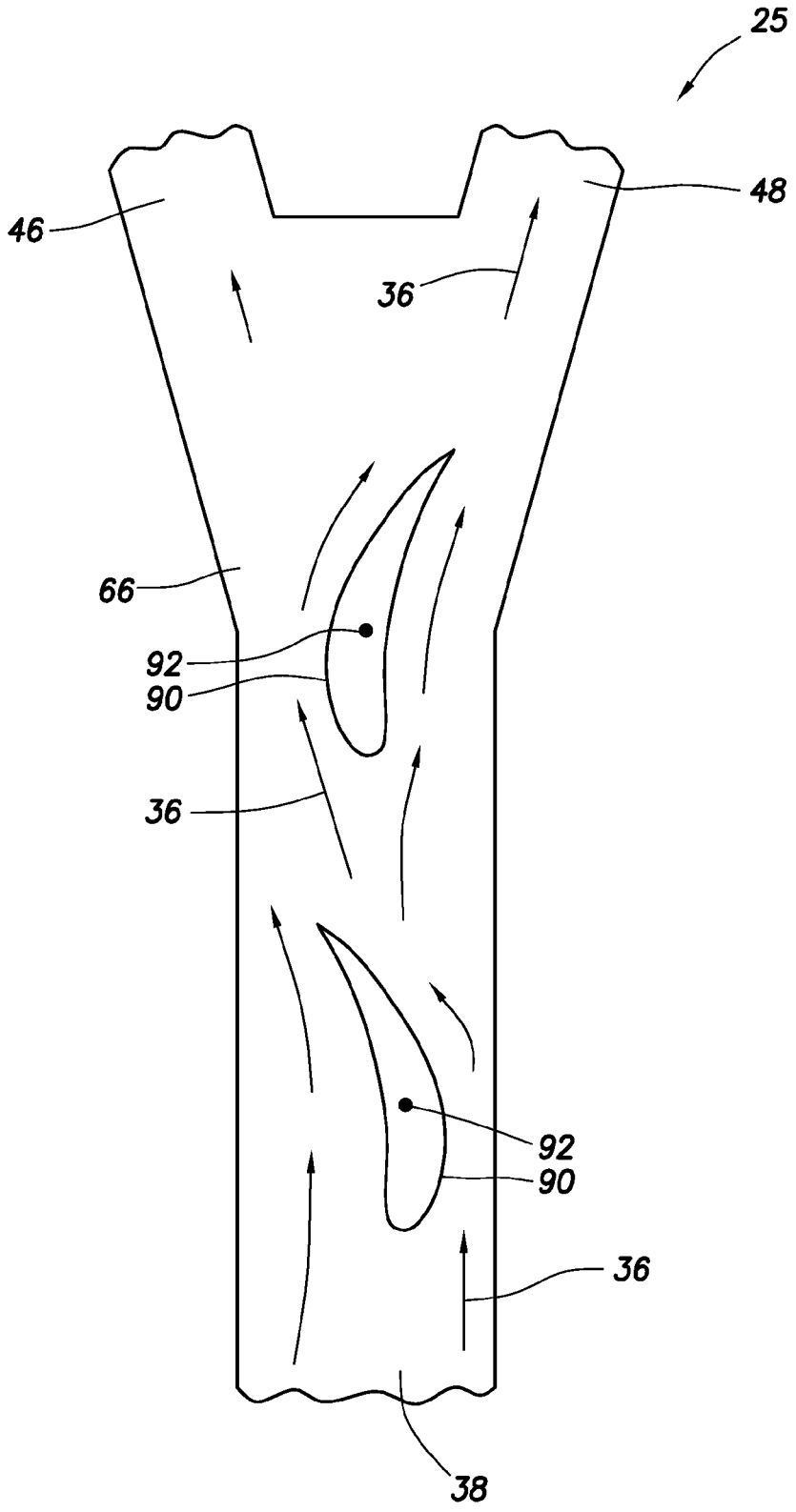

In the configuration of FIG. 23, the multiple airfoils 90 are longitudinally spaced apart. In some examples, the airfoils 90 could be directly inline with each other.

In the FIG. 23 example, the upstream airfoil 90 directs the flow of the fluid composition 36, so that it is advantageously directed toward the downstream airfoil. However, other purposes could be served by longitudinally spacing apart the airfoils 90, in keeping with the scope of this disclosure.

Figure 24:
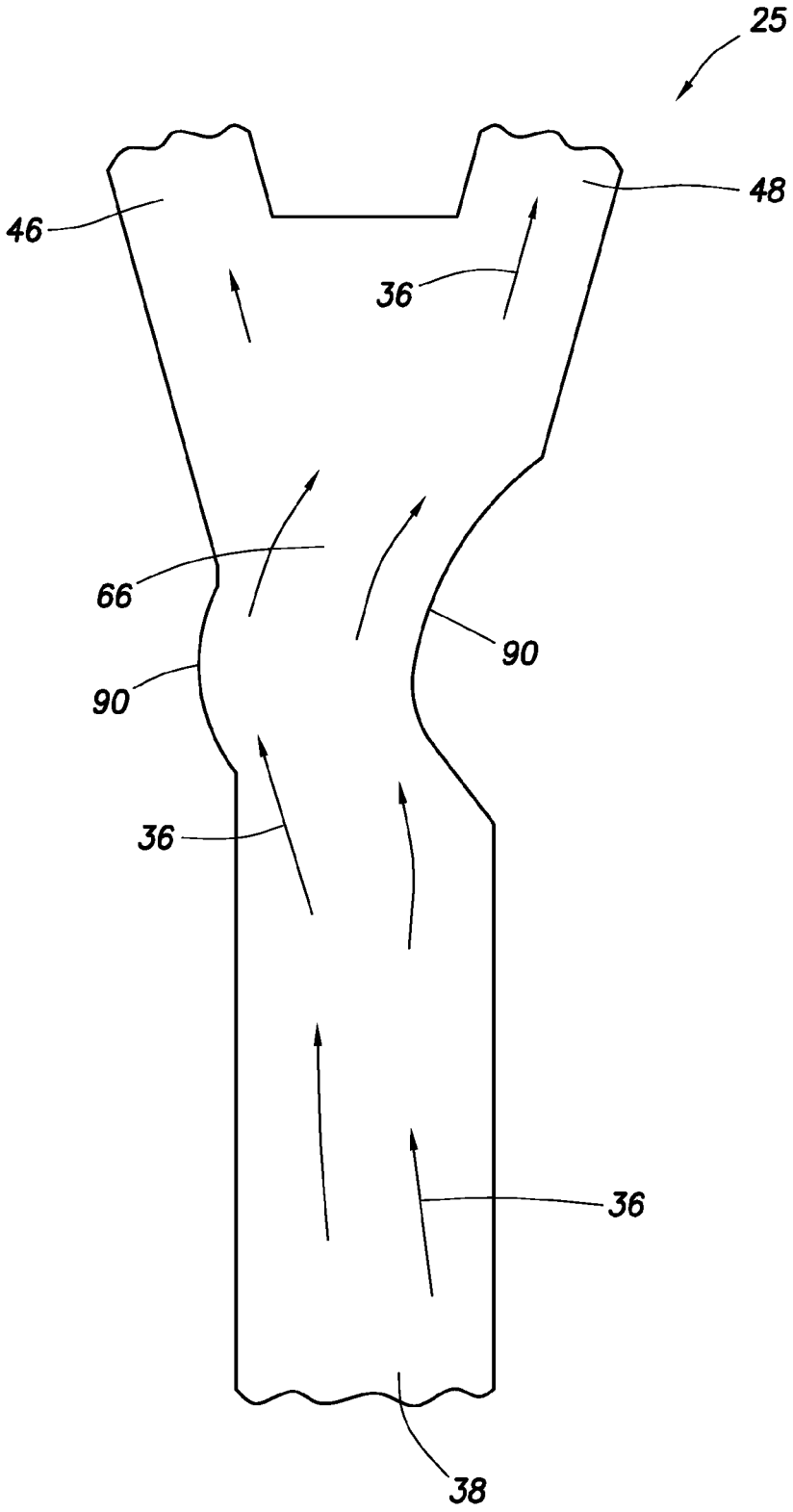

In the configuration of FIG. 24, airfoil-like surfaces are formed on the walls of the fluid switch 66. In this manner, the fluid composition 36 is preferentially directed toward the flow path 48 at certain conditions (e.g., high flow velocity, low viscosity, etc.). However, at other conditions (e.g., low flow velocity, high viscosity, etc.), the fluid composition 36 is able to flow relatively equally to the flow paths 46, 48.

Figure 25:
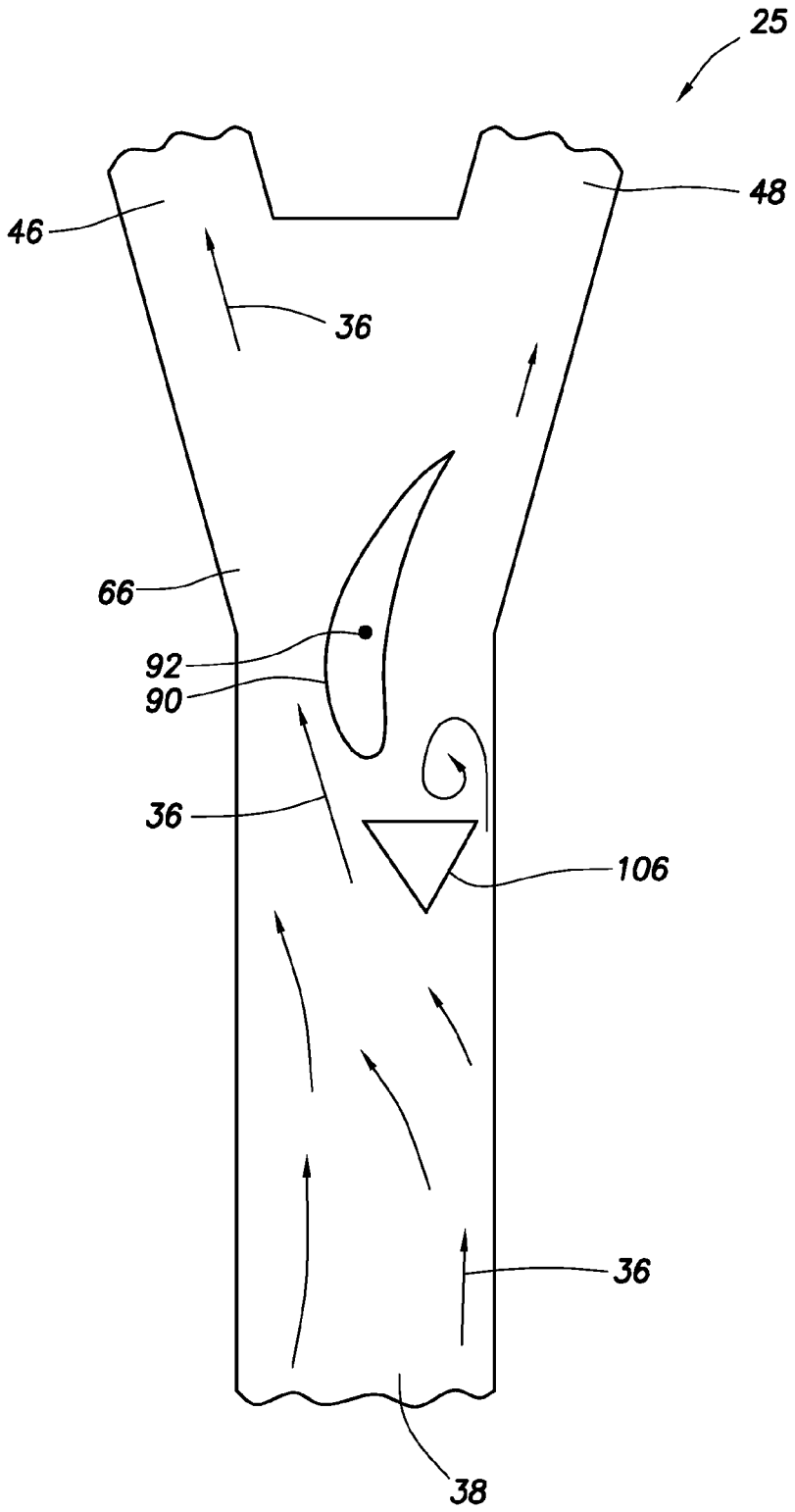

In the FIG. 25 example, a wedge-shaped blockage 106 is positioned upstream of the airfoil 90. The blockage 106 serves to influence the flow of the fluid composition 36 over the airfoil 90. The blockage 106 could also be a magnetic device for applying a biasing force to the airfoil 90.

Figure 26:
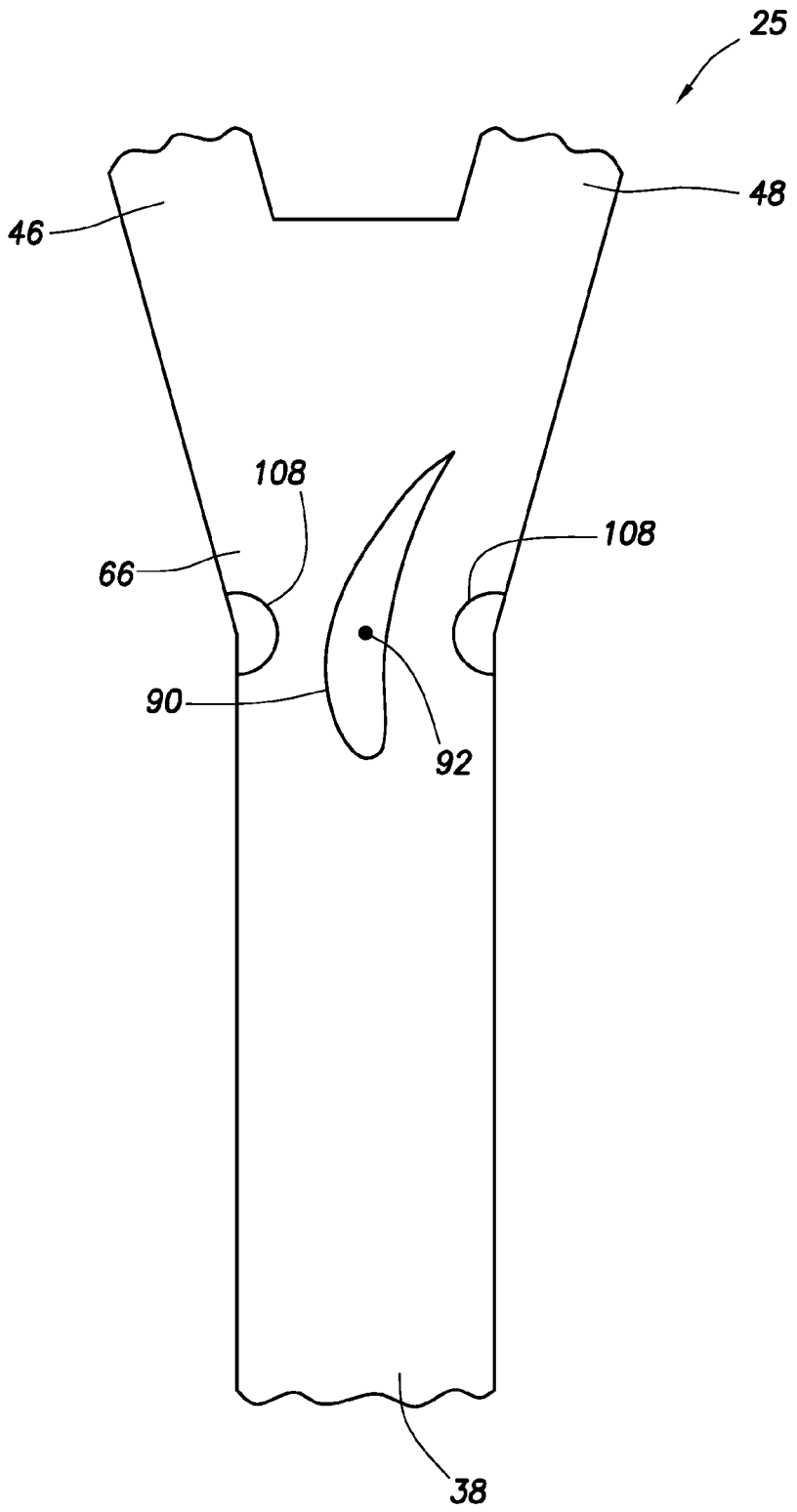

In the FIG. 26 example, cylindrical projections 108 are positioned on opposite lateral sides of the fluid switch 66. The cylindrical projections 108 serve to influence the flow of the fluid composition 36 over the airfoil 90. The cylindrical projections 108 could also be magnetic devices (such as, magnetic biasing devices 96, 98) for applying a biasing force to the airfoil 90.

Figure 27:
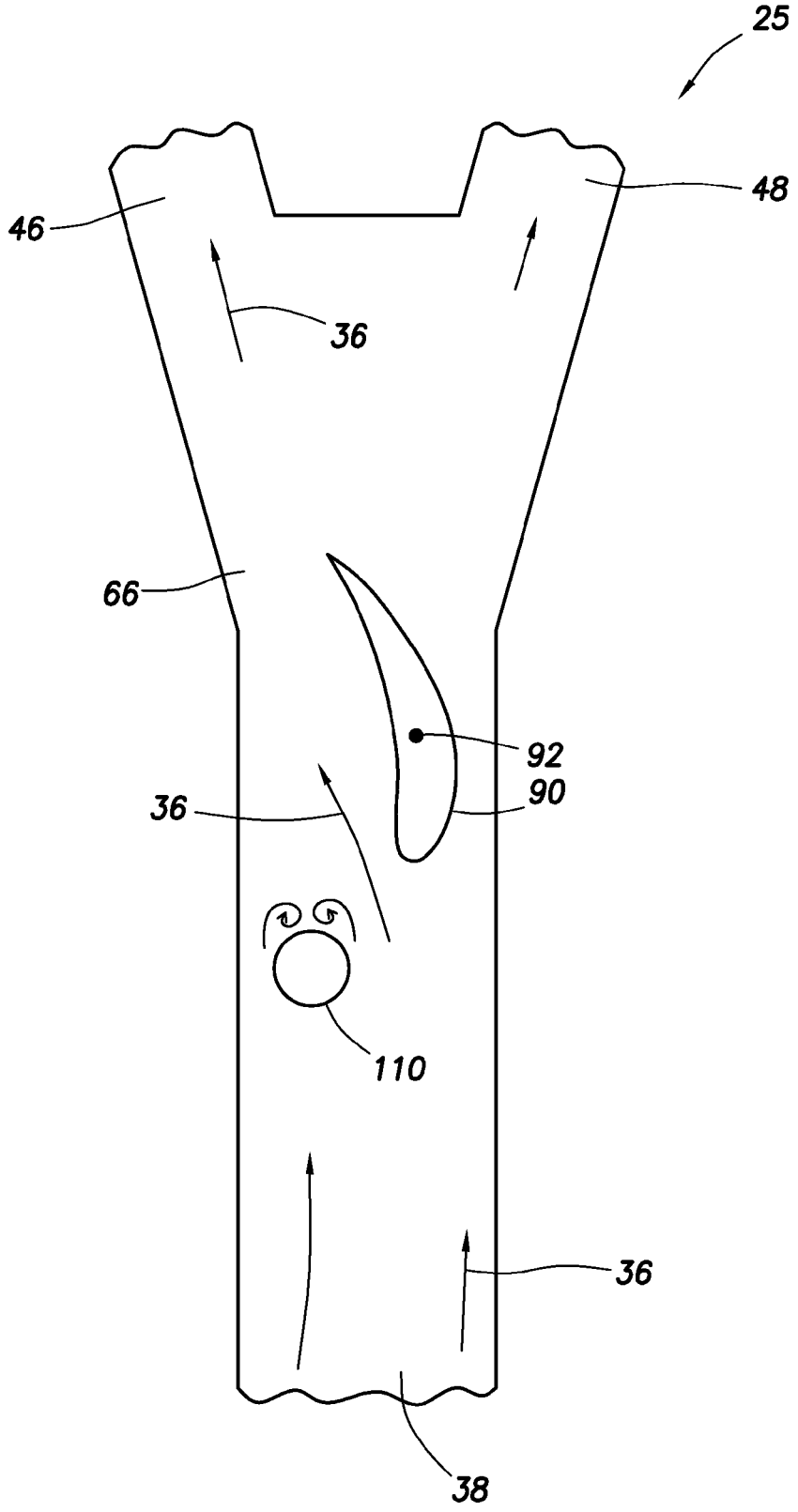

In the FIG. 27 example, a cylindrical blockage 110 is positioned upstream of the airfoil 90. The blockage 110 serves to influence the flow of the fluid composition 36 over the airfoil 90. The blockage 110 could also be a magnetic device for applying a biasing force to the airfoil 90.

It may now be fully appreciated that this disclosure provides significant advancements to the art of variably resisting flow in conjunction with well operations. In multiple examples described above, flow resistance can be reliably and efficiently increased when there is a relatively large ratio of desired to undesired fluid in the fluid composition 36, and/or flow resistance can be decreased when there is a reduced ratio of desired to undesired fluid in the fluid composition.

A variable flow resistance system 25 for use with a subterranean well is described above. In one example, the system 25 includes a structure 58 which displaces in response to a flow of a fluid composition 36, whereby a resistance to the flow of the fluid composition 36 changes in response to a change in a ratio of desired to undesired fluid in the fluid composition 36.

The structure 58 may be exposed to the flow of the fluid composition 36 in multiple directions, and the resistance to the flow can change in response to a change in a proportion of the fluid composition 36 which flows in those directions.

The structure 58 can be more biased in one direction by the flow of the fluid composition 36 more in one direction, and the structure 58 can be more biased in another direction by the flow of the fluid composition 36 more in the second direction.

The first and second directions may be opposite directions. The directions can comprise at least one of the group including circumferential, axial, longitudinal, lateral, and radial directions.

The system 25 can include a fluid switch 66 which directs the flow of the fluid composition 36 to at least two flow paths 46, 48.

The structure 58 may be more biased in one direction by the flow of the fluid composition 36 more through the first flow path 46, and the structure may be more biased in a another direction by the flow of the fluid composition 36 more through the second flow path 48.

The structure 58 may pivot or rotate, and thereby vary the resistance to flow, in response to a change in a proportion of the fluid composition 36 which flows through the first and second flow paths 46, 48.

The structure 58 may rotate, and thereby vary the resistance to flow, in response to the change in the ratio of desired to undesired fluids.

The fluid switch 66 can comprise a blocking device 76 which at least partially blocks the flow of the fluid composition 36 through at least one of the first and second flow paths 46, 48. The blocking device 76 may increasingly block one of the first and second flow paths 46, 48, in response to the flow of the fluid composition 36 toward the other of the first and second flow paths 46, 48.

The fluid switch 66 may direct the flow of the fluid composition 36 toward one of the first and second flow paths 46, 48 in response to the blocking device 76 increasingly blocking the other of the first and second flow paths 46, 48.

The system 25 can include an airfoil 90 which deflects the flow of the fluid composition 36 in response to the change in the ratio of desired to undesired fluid.

The system 25 can include a material 86, 88 which swells in response to a decrease in the ratio of desired to undesired fluid, whereby the resistance to flow is increased.

In some examples, the resistance to flow decreases in response to an increase in the ratio of desired to undesired fluid. In some examples, the resistance to flow increases in response to a decrease in the ratio of desired to undesired fluid.

Also described above is another variable flow resistance system 25 example in which a structure 58 rotates in response to flow of a fluid composition 36, and a fluid switch 66 deflects the fluid composition 36 relative to at least first and second flow paths 46, 48, and a resistance to the flow of the fluid composition 36 through the system 25 changes in response to a change in a ratio of desired to undesired fluid in the fluid composition 36.

The structure 58 may be exposed to the flow of the fluid composition 36 through the first and second flow paths 46, 48, and the resistance to the flow can change in response to a change in a proportion of the fluid composition 36 which flows through the first and second flow paths 46, 48.

In another example, a variable flow resistance system 25 can include a chamber 50 through which a fluid composition 36 flows, whereby a resistance to a flow of the fluid composition 36 through the chamber 50 varies in response to a change in a direction of the flow through the chamber 50. A material 86, 88 swells in response to a decrease in a ratio of desired to undesired fluid in the fluid composition 36.

The resistance to the flow can increase or decrease when the material 86, 88 swells.

The material 86, 88 may increasingly influence the fluid composition 36 to flow spirally through the chamber 50 when the material 86, 88 swells.

The material 88 may increasingly block the flow of the fluid composition 36 through the system 25 when the material 88 swells.

The material 86 may increasingly deflect the flow of the fluid composition 36 when the material 36 swells.

The system 25 can also include a structure 25 which displaces in response to the flow of the fluid composition 36, whereby the resistance to the flow of the fluid composition 36 increases in response to a decrease in the ratio of desired to undesired fluid. The structure 58 may rotate in response to the change in the ratio of desired to undesired fluid.

Another variable flow resistance system 25 example described above can include at least first and second flow paths 46, 48, whereby a resistance to a flow of a fluid composition 36 through the system 25 changes in response to a change in a proportion of the fluid composition 36 which flows through the first and second flow paths 46, 48. One or more airfoils 90 may change a deflection of the flow of the fluid composition 36 relative to the first and second flow paths 46, 48 in response to a change in a ratio of desired to undesired fluid in the fluid composition 36.

The airfoil 90 may rotate in response to the change in the ratio of desired to undesired fluid in the fluid composition 36.

The airfoil 90 may change the deflection in response to a change in viscosity, velocity and/or density of the fluid composition 36.

The system 25 can include a magnetic biasing device 94, 96 or 98 which exerts a magnetic force on the airfoil 90, whereby the airfoil 90 deflects the fluid composition 36 toward a corresponding one of the first and second flow paths 46, 48. The system 25 can include first and second magnetic biasing devices 94, 96 which exert magnetic forces on the airfoil 90, whereby the airfoil 90 deflects the fluid composition 36 toward respective ones of the first and second flow paths 46, 48.

The system 25 can include a structure 58 which displaces in response to the flow of the fluid composition 36, whereby the resistance to the flow of the fluid composition 36 increases in response to a decrease in the ratio of desired to undesired fluid. The system 25 may include a structure 58 which rotates in response to the change in the ratio of desired to undesired fluid.

The system 25 can comprise multiple airfoils 90. The airfoils 90 may be constrained to rotate together, or they may be allowed to displace independently of each other. The airfoils 90 may be displaceable laterally and longitudinally relative to the first and second flow paths 46, 48. The airfoils 90 may be laterally and/or longitudinally spaced apart.

A method of variably resisting flow in a subterranean well is also described above. In one example, the method can include a structure 58 displacing in response to a flow of a fluid composition 36, and a resistance to the flow of the fluid composition 36 changing in response to a ratio of desired to undesired fluid in the fluid composition changing.

The method may include exposing the structure 58 to the flow of the fluid composition 36 in at least first and second directions. The resistance to the flow changing can be further in response to a change in a proportion of the fluid composition 36 which flows in the first and second directions.

The structure 58 may be increasingly biased in a first direction by the flow of the fluid composition 36 increasingly in the first direction, and the structure 58 may be increasingly biased in a second direction by the flow of the fluid composition 36 increasingly in the second direction.

The first direction may be opposite to the second direction. The first and second directions may comprise any of circumferential, axial, longitudinal, lateral, and radial directions.

The method can include a fluid switch 66 directing the flow of the fluid composition 36 toward at least first and second flow paths 46, 48. The structure 58 may be increasingly biased in a first direction by the flow of the fluid composition 36 increasingly through the first flow path 46, and the structure 58 may be increasingly biased in a second direction by the flow of the fluid composition 36 increasingly through the second flow path 48.

The structure 58 displacing may include the structure 58 pivoting or rotating, and thereby varying the resistance to flow, in response to a change in a proportion of the fluid composition 36 which flows through the first and second flow paths 46, 48.

The structure 58 displacing may include the structure 58 rotating, and thereby varying the resistance to flow, in response to the change in the ratio of desired to undesired fluids.

The method may include a blocking device 76 of the fluid switch 66 at least partially blocking the flow of the fluid composition 36 through at least one of the first and second flow paths 46, 48. The blocking device 76 can increasingly block one of the first and second flow paths 46, 48, in response to the flow of the fluid composition toward the other of the first and second flow paths.

The fluid switch 66 can direct the flow of the fluid composition 36 toward one of the first and second flow paths 46, 48 in response to the blocking device 76 increasingly blocking the other of the first and second flow paths 46, 48.

The method may include an airfoil 90 deflecting the flow of the fluid composition 36 in response to the ratio of desired to undesired fluid changing.

The method may include a material 86, 88 swelling in response to the ratio of desired to undesired fluid decreasing. The resistance to the flow changing can include the resistance to the flow increasing in response to the material 86, 88 swelling.

The resistance to the flow changing can include the resistance to the flow increasing or decreasing in response to the ratio of desired to undesired fluid increasing.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

It should be be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A variable flow resistance system for use with a subterranean well, the system comprising:

a structure which displaces in response to a flow of a fluid composition, whereby a resistance to the flow of the fluid composition changes in response to a change in a ratio of desired to undesired fluid in the fluid composition; and an airfoil which deflects the flow of the fluid composition in response to the change in the ratio of desired to undesired fluid.

2. A variable flow resistance system for use with a subterranean well, the system comprising:

at least first and second flow paths, whereby a resistance to a flow of a fluid composition through the system changes in response to a change in a proportion of the fluid composition which flows through the first and second flow paths; and at least one airfoil which changes a deflection of the flow of the fluid composition relative to the first and second flow paths in response to a change in a ratio of desired to undesired fluid in the fluid composition.

3. The system of claim 2, wherein the airfoil rotates in response to the change in the ratio of desired to undesired fluid in the fluid composition.

4. The system of claim 2, wherein the airfoil changes the deflection in response to a change in at least one of the group comprising viscosity, velocity and density of the fluid composition.

5. The system of claim 2, further comprising a structure which displaces in response to the flow of the fluid composition, whereby the resistance to the flow of the fluid composition increases in response to a decrease in the ratio of desired to undesired fluid.

6. The system of claim 2, further comprising a structure which rotates in response to the change in the ratio of desired to undesired fluid.

7. The system of claim 2, wherein the at least one airfoil comprises multiple airfoils.

8. The system of claim 7, wherein the airfoils are constrained to rotate together.

9. The system of claim 7, wherein the airfoils displace independently of each other.

10. The system of claim 7, wherein the airfoils are displaceable laterally and longitudinally relative to the first and second flow paths.

11. The system of claim 7, wherein the airfoils are laterally spaced apart.

12. The system of claim 7, wherein the airfoils are longitudinally spaced apart.

* * * * *